US007017558B2

(12) United States Patent
Osanai

(10) Patent No.: US 7,017,558 B2
(45) Date of Patent: Mar. 28, 2006

(54) EVAPORATIVE EMISSION CONTROL SYSTEM

(75) Inventor: Akinori Osanai, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 110 days.

(21) Appl. No.: 10/864,549

(22) Filed: Jun. 10, 2004

(65) Prior Publication Data

US 2004/0261765 A1 Dec. 30, 2004

(30) Foreign Application Priority Data

Jun. 27, 2003 (JP) ..... 2003-185738

(51) Int. Cl.
*F02D 41/00* (2006.01)

(52) U.S. Cl. ..... 123/520; 123/198 D; 123/198 DB; 123/479; 123/339.15; 123/491

(58) Field of Classification Search ..... 123/516, 123/518, 519, 520, 198 D, 198 DB, 479, 123/179.16, 674, 690, 698, 491, 478, 339.15
See application file for complete search history.

(56) References Cited

U.S. PATENT DOCUMENTS 5,295,472 A 3/1994 Otsuka et al.
6,047,692 A * 4/2000 Toyoda ..... 123/698
6,736,116 B1 * 5/2004 Kawano ..... 123/520
6,840,223 B1 * 1/2005 Fukuhara ..... 123/458
2003/0019481 A1 * 1/2003 Kawano ..... 123/520
2003/0029226 A1 * 2/2003 Kawano ..... 73/40.5 R
2004/0094133 A1 * 5/2004 Lingenhult et al. ..... 123/519
2004/0244781 A1 * 12/2004 Toyoda ..... 123/520

FOREIGN PATENT DOCUMENTS

JP A 5-180101 7/1993
JP A 6-58197 3/1994
JP A 11-141413 5/1999

* cited by examiner

*Primary Examiner*—Thomas Moulis
(74) *Attorney, Agent, or Firm*—Kenyon & Kenyon LLP

(57) ABSTRACT

An evaporative emission control system detects an opening failure of a purge control valve that controls the amount of purge gas flowing from a canister into an intake passage of the engine, and determines whether a significant shift occurs in an air/fuel ratio feedback factor when the opening failure is detected. If the air/fuel ratio feedback factor is shifted to the rich side, a rich-side initial value is set to a vapor concentration learned value, and, if the feedback factor is shifted to the lean side, a lean-side initial value is set to the vapor concentration learned value. These initial values give larger changes to the vapor concentration learned value than update amounts by which the learned value is updated during normal learning control.

30 Claims, 13 Drawing Sheets

EVAPORATIVE EMISSION CONTROL SYSTEM

INCORPORATION BY REFERENCE

The disclosure of Japanese Patent Application No. 2003-185738 filed on Jun. 27, 2003, including the specification, drawings and abstract, is incorporated herein by reference in its entirety.

BACKGROUND OF THE INVENTION

1. Field of the Invention

The invention generally relates to evaporative emission control systems, and, more particularly, to evaporative emission control systems in which fuel vapor collected in a canister is drawn into an intake passage of an internal combustion engine for disposal in the engine.

2. Description of Related Art

For example, an evaporative emission control system as disclosed in Japanese Laid-open Patent Publication No. 6-58197 is known which includes a canister for collecting fuel vapor generated in a fuel tank, and a purge control valve that communicates the canister with an intake passage of an internal combustion engine as needed. In this system, when the purge control valve is opened, the intake manifold vacuum is fed to the canister so that the fuel vapor collected in the canister is drawn with air into the intake passage. Thus, the known system is able to dispose of fuel vapor generated in the fuel tank without releasing the same to the atmosphere.

According to a method as disclosed in the above-identified patent publication, the system detects an opening failure of the purge control valve (which occurs when the valve is stuck in the open state), and performs control for correcting the air/fuel ratio while stopping learning of the air/fuel ratio when it determines that an opening failure occurs in the purge control valve. The air/fuel ratio correction control includes the steps of estimating the amount of flow of purge gas based on the engine speed and other parameter(s), and correcting the air/fuel ratio based on the estimated purge gas flow, as disclosed in the above-identified publication. With the known control method, the system can correct the air/fuel ratio by some degree in view of an influence of purge gas arising from an opening failure of the purge control valve, and reduce or suppress fluctuations in the air/fuel ratio, which would otherwise occur in the event of the opening failure.

When an opening failure occurs in the purge control valve, a large amount of purge gas constantly flows into the intake passage of the engine. In the meantime, the operating state of the engine varies with time, and the engine may be placed in various situations, such as a situation in which a large amount of intake air is generated, a situation in which only a slight amount of intake air is generated, a situation in which fuel injection should be stopped, and a situation in which the fuel injection amount should be increased. Under these various situations, appropriate air/fuel ratio control cannot be maintained all the time if the air/fuel ratio is merely corrected based on the estimated amount of flow of purge gas as in the known system described above.

SUMMARY OF THE INVENTION

It is therefore an object of the invention to provide an evaporative emission control system that performs an appropriate process depending upon the operating conditions of the engine when an opening failure occurs in a purge control valve, thereby to achieve highly accurate air/fuel ratio control.

To accomplish the above and/or other object(s), there is provided according to a first aspect of the invention an evaporative emission control system including a canister for collecting fuel vapor flowing from a fuel tank, comprising: (a) a purge control valve that controls a degree of fluid communication between the canister and an intake passage of an internal combustion engine, (b) an air/fuel ratio deviation detecting unit that detects a deviation of an air/fuel ratio from a predetermined range under a situation where purge gas is supplied to the intake passage, (c) a fuel injection amount calculating unit that calculates a fuel injection amount according to an expression including a correction factor for canceling an influence of the purge gas, (d) a correction factor updating unit that updates the correction factor so as to reduce the deviation of the air/fuel ratio, (e) an opening failure detecting unit that detects an opening failure of the purge control valve, the opening failure occurring when the purge control valve is stuck in an open state, (f) a deviating condition determining unit that determines the presence and direction of the deviation of the air/fuel ratio when the opening failure is detected, and (g) an initial value setting unit that assigns a rich-side initial value or a lean-side initial value to the correction factor depending upon the direction of the deviation of the air/fuel ratio when the deviating condition determining unit determines the presence of the deviation of the air/fuel ratio. In this system, a difference between a reference value of the correction factor and the rich-side initial value and a difference between the reference value and the lean-side initial value are both larger than an update amount of the correction factor by which the correction factor is updated at a time by the correction factor updating unit.

In the system according to the first aspect of the invention, when an opening failure of the purge control valve is detected, the presence or the absence of a deviation of the air/fuel ratio and the direction of the deviation are determined. If the presence of the deviation of the air/fuel ratio is determined, the rich-side initial value or the lean-side initial value can be assigned to the correction factor for canceling the influence of the purge gas. These initial values give a larger change to the correction factor than the update amount by which the correction factor is updated at a time in the normal learning process. Thus, the system according to the above aspect of the invention can rapidly make the correction factor close to or equal to an appropriate value even in the event of an opening failure of the purge control valve, and is thus able to achieve excellent air/fuel ratio control.

In one embodiment of the first aspect of the invention, the correction factor updating unit determines the presence of the deviation of the air/fuel ratio if the deviation satisfies a first condition, and updates the correction factor so as to reduce the deviation of the air/fuel ratio, and the deviating condition determining unit determines the presence of the deviation of the air/fuel ratio if the deviation satisfies a second condition. Furthermore, the deviation that satisfies the second condition is detected with a higher sensitivity than the deviation that satisfies the first condition.

According to the embodiment as described above, when an opening failure occurs in the purge control valve, the deviation of the air/fuel ratio is detected with high sensitivity so that the initial value can be assigned to the correction factor. Thus, according to this embodiment of the invention, the correction factor can be largely changed toward the appropriate value immediately after detection of the opening failure. On the other hand, when the correction factor is normally updated, the deviation of the air/fuel ratio can be detected with relatively low sensitivity. Thus, the correction factor is prevented from being inappropriately or unnecessarily updated in response to slight fluctuations in the air/fuel ratio.

According to a second aspect of the invention, there is provided an evaporative emission control system including a canister for collecting fuel vapor flowing from a fuel tank, comprising: (a) a purge control valve that controls a degree of fluid communication between the canister and an intake passage of an internal combustion engine, (b) a fuel cut control unit that executes fuel cut control for stopping fuel injection into the engine when predetermined fuel cut conditions are satisfied, (c) an opening failure detecting unit that detects an opening failure of the purge control valve, the opening failure occurring when the purge control valve is stuck in an open state, and (d) a fuel cut restricting unit that restricts execution of the fuel cut control when the opening failure is detected.

In the system according to the second aspect of the invention, when an opening failure occurs in the purge control valve, execution of fuel cut control can be restricted. Thus, the system of the invention can avoid a situation where fuel cut control is executed while purge gas is flowing in the intake passage of the engine, namely, a situation where purge gas containing a fuel component flows into a catalyst without being subjected to combustion in the cylinders. Thus, the catalyst can be effectively protected according to the above aspect of the invention.

In one embodiment of the second aspect of the invention, the evaporative emission control system further includes a condition distinguishing unit that distinguishes between a first condition in which a fuel concentration of purge gas is higher than a criteria value and a second condition in which the fuel concentration is lower than the criteria value, and the fuel cut restricting unit restricts execution of the fuel cut control only under the first condition in which the fuel concentration of purge gas flowing due to the opening failure of the purge control valve is higher than the criteria value.

According to the embodiment as described above, execution of the fuel cut control can be restricted only under a situation where the fuel concentration of the purge gas is high. If the fuel concentration of the purge gas is sufficiently low, there is no need to restrict execution of the fuel cut control. Thus, the system as described just above can avoid unnecessary restrictions on execution of the fuel cut control where the fuel concentration of the purge gas is sufficiently low.

In another embodiment of the second aspect of the invention, the predetermined fuel cut conditions include a condition that an engine speed is higher than a predetermined fuel cut speed, and the fuel cut restricting unit changes the predetermined fuel cut speed from a normal value employed when the purge control valve is normal, to a higher value than the normal value, when the opening failure of the purge control valve is detected.

According to the embodiment as described above, when an opening failure occurs in the purge control valve, the fuel cut speed is set at a relatively high value so that execution of the fuel cut control can be restricted. In this manner, the system provides an effect of improving fuel economy by utilizing the fuel cut control, while at the same time protecting the catalyst.

In a further embodiment of the second aspect of the invention, the fuel cut restricting unit restricts execution of the fuel cut control by inhibiting the fuel cut control.

According to the embodiment as described above, when an opening failure occurs in the purge control valve, the system inhibits execution of the fuel cut control so as to completely prevent gas containing unburned components from flowing into the catalyst. Thus, the system of the above embodiment of the invention can achieve excellent catalyst protection in the event of an opening failure of the purge control valve.

According to a third aspect of the invention, there is provided an evaporative emission control system including a canister for collecting fuel vapor flowing from a fuel tank, comprising: (a) a purge control valve that controls a degree of fluid communication between the canister and an intake passage of an internal combustion engine, (b) a cold-start correcting unit that performs correction for increasing a fuel injection amount during a cold start of the engine, (c) an opening failure detecting unit that detects an opening failure of the purge control valve, the opening failure occurring when the purge control valve is stuck in an open state, and (d) a correction amount reducing unit that reduces an amount by which the fuel injection amount is increased by the cold-start correcting unit when the opening failure is detected.

The system according to the third aspect of the invention can prevent the air/fuel ratio from being excessively rich when correction for increasing the fuel injection amount is performed upon a cold start of the engine while a large amount of fuel vapor is flowing into the engine due to an opening failure of the purge control valve.

In one embodiment of the third aspect of the invention, the system further includes an excessive richness determining unit that determines whether an air/fuel ratio indicates an excessively fuel-rich condition, and the correction amount reducing unit reduces the amount by which the fuel injection amount is increased by the cold-start correcting unit only when the opening failure of the purge control valve is detected and it is determined that the air/fuel ratio indicates the excessively rich condition.

According to the embodiment as described above, the amount of increase of the fuel injection amount can be reduced only in the case where the actual air/fuel ratio is made excessively rich due to execution of the cold-start correction for increasing the fuel injection amount. Thus, the system according to the above embodiment can avoid an unnecessary reduction in the correction amount by which the fuel injection amount is increased upon a cold start of the engine.

According to a fourth aspect of the invention, there is provided an evaporative emission control system including a canister for collecting fuel vapor flowing from a fuel tank, comprising: (a) a purge control valve that controls a degree of fluid communication between the canister and an intake passage of an internal combustion engine, (b) an idle air flow controller that allows a desired amount of idle air to flow during idling of the engine, (c) an opening failure detecting unit that detects an opening failure of the purge control valve, the opening failure occurring when the purge control valve is stuck in an open state, and (d) an idle air amount increasing unit that increases the amount of idle air when the opening failure is detected.

According to the fourth aspect of the invention, when an opening failure of the purge control valve is detected, the amount of intake air flowing during idling of the engine can be increased. With the amount of idle air thus increased, the influence of the purge gas on the air/fuel ratio during idling can be reduced. Thus, the system according to the above aspect of the invention provides a stable idling state when an opening failure occurs in the purge control valve.

In one embodiment of the fourth aspect of the invention, the system further includes a fuel concentration acquiring unit that detects or estimates a fuel concentration of purge gas, and the idle air amount increasing unit increases the amount of idle air by an amount that increases as the fuel concentration of the purge gas is higher.

According to the embodiment as described above, the amount of idle air (i.e., the amount of air flowing during idling of the engine) can be increased with an increase in the fuel concentration of the purge gas. While the engine is idling, the air/fuel ratio is likely to be richer as the fuel concentration of the purge gas is higher. Since the amount of idle air can be set to an adequate amount depending upon the fuel concentration of the purge gas, the system according to the above embodiment can establish a stable idling state without unnecessarily increasing the idle air amount.

In another embodiment of the fourth aspect of the invention, the idle air flow controller controls the amount of idle air so that an idle speed becomes substantially equal to a target idle speed, and the idle air amount increasing unit comprises a target speed changing unit that changes the target idle speed to a speed higher than a normal target speed when the opening failure is detected.

According to the embodiment as described above, when an opening failure occurs in the purge control valve, the amount of idle air can be increased by increasing the target idle speed to be achieved.

In a further embodiment of the fourth aspect of the invention, the idle air flow controller controls the amount of idle air so that an idle speed becomes substantially equal to a target idle speed, and the idle air amount increasing unit comprises an ignition timing retarding unit that retards an ignition timing of the engine relative to a normal ignition timing when the opening failure is detected.

According to the embodiment as described above, when an opening failure occurs in the purge control valve, the amount of idle air can be increased by retarding the ignition timing so as to reduce the output torque per unit air amount.

According to a fifth aspect of the invention, there is provided an evaporative emission control system including a canister for collecting fuel vapor flowing from a fuel tank, wherein the canister has a vapor port that communicates with the fuel tank, a purge port that communicates with an intake passage of an internal combustion engine, and an atmospheric vent located opposite to the vapor port and the purge port with an inside space of the canister interposed therebetween, comprising: (a) a purge control valve that controls a degree of fluid communication between the purge port and the intake passage, (b) a canister check valve that opens and closes the atmospheric vent, (c) an opening failure detecting unit that detects an opening failure of the purge control valve, the opening failure occurring when the purge control valve is stuck in an open state, and (d) an atmospheric vent closing unit that places the canister check valve in a closed state so as to close the atmospheric vent when the opening failure is detected.

According to the fifth aspect of the invention, when an opening failure occurs in the purge control valve, the canister check valve is closed so that flow of air into the canister can be restricted. If the flow of air into the canister is restricted, purging of fuel vapor adsorbed in the canister can be suppressed or limited, and the amount of purge gas flowing into the intake passage can be reduced. Thus, the system according to the above aspect of the invention is able to sufficiently reduce the influence of the purge gas on the air/fuel ratio in the event of an opening failure of the purge control valve, thereby to achieve excellent air/fuel ratio control.

In one embodiment of the fifth aspect of the invention, the system further includes a condition distinguishing unit that distinguishes between a first condition in which purge gas flowing in the system has a high fuel concentration and a second condition in which purge gas flowing in the system has a low fuel concentration, and the atmospheric vent closing unit places the canister check valve in the closed state under the first condition in which purge gas flowing due to the opening failure of the purge control valve has a high fuel concentration.

According to the embodiment as described above, the canister check valve is closed only when the fuel concentration of the purge gas is relatively high. If the canister check valve is closed, air is inhibited from flowing into the canister, and therefore gas in the fuel tank is likely to be drawn into the intake passage. When the fuel concentration of the purge gas flowing from the canister is relatively low, on the other hand, it is more desirable that the low-fuel-concentration purge gas flows from the canister into the intake passage than that gas in the fuel tank is drawn into the intake passage. The system according to the above embodiment of the invention meets this requirement, and is thus able to achieve the optimum operating state depending upon the fuel concentration of the purge gas.

In another embodiment of the fifth aspect of the invention, the system further includes a check valve that opens so as to permit air to flow into a system including the fuel tank and the canister when a pressure in the system reaches a predetermined negative level.

According to the embodiment as described above, the check valve functions to permit air to flow into the system including the fuel tank and the canister, so that the pressure in the system is prevented from being unduly lowered to a large negative level when the canister check valve is closed. Thus, the system according to the above embodiment of the invention can surely prevent an excessively large pressure or stress from being applied to the fuel tank or canister while restricting the purge gas flow by closing the canister check valve when appropriate.

In the embodiment as described just above, the check valve may be provided at the fuel tank. With this arrangement, when a large negative pressure is developed in the system while the canister check valve is closed, air can be introduced through the check valve provided on the side of the fuel tank. In this case, purge gas flowing into the intake passage mainly consists of gas flowing from the fuel tank, rather than purge gas flowing from the canister. The purge gas flowing from the canister may have a high fuel concentration if a large amount of fuel is adsorbed in the canister. On the other hand, the gas flowing from the tank is composed of fuel vapor generated in the fuel tank, and air that dilutes the fuel vapor. Since the gas drawn into the intake passage consists mainly of the gas from the fuel tank, the system can avoid a situation where purge gas having an excessively high fuel concentration flows into the intake passage.

In the embodiment as described above, the system may further include (a) an air/fuel ratio deviation detecting unit that detects a deviation of an air/fuel ratio from a predetermined range under a situation where purge gas is supplied to the intake passage, (b) a fuel injection amount calculating unit that calculates a fuel injection amount according to an expression including a correction factor for canceling an influence of the purge gas, (c) a correction factor updating unit that updates the correction factor so as to reduce the deviation of the air/fuel ratio, and (d) an initial value setting unit that assigns an initial value to the correction factor when the canister check valve is placed in the closed state upon detection of the opening failure of the purge control valve. In this system, a difference between a reference value of the correction factor and the initial value is larger than an update amount of the correction factor by which the correction factor is updated at a time by the correction factor updating unit.

With the above arrangement, under a situation where the canister check valve is closed upon detection of an opening failure of the purge control valve, the initial value can be immediately set to the correction factor for canceling the influence of the purge gas. Under the above situation, gas that flows from the fuel tank is drawn as purge gas into the intake passage. In this case, the fuel concentration of the purge gas can be treated as fixed to some extent. In the embodiment as described above, the initial value corresponding to the fuel concentration as the fixed value is set to the correction factor. Thus, the system according to the above embodiment of the invention is able to quickly make the correction factor close to or equal to the proper value after the opening failure of the purge control valve is detected, thus assuring excellent air/fuel ratio control.

In the embodiment as described above, the system may further include (a) a fuel injection amount calculating unit that calculates a fuel injection amount according to an expression including a correction factor for canceling an influence of the purge gas, (b) a correction factor calculating unit that calculates the correction factor based on a fuel concentration of the purge gas, (c) a purge gas flow detecting unit that detects an amount of flow of the purge gas, (d) a gas flow determining unit that determines whether the amount of flow of the purge gas is smaller than an amount of tank vapor generated in the fuel tank when the opening failure is detected, (e) a first concentration setting unit that sets a fuel concentration equivalent to that of the tank vapor to the fuel concentration of the purge gas when the gas flow determining unit determines that the amount of flow of the purge gas is smaller than the amount of the tank vapor under a condition where the opening failure is detected, and (f) a second concentration setting unit that calculates a reduced fuel concentration based on the fuel concentration equivalent to that of the tank vapor, the amount of the tank vapor and the amount of flow of the purge gas, and sets the reduced fuel concentration to the fuel concentration of the purge gas, when the gas flow determining unit determines that the amount of flow of the purge gas is equal to or larger than the amount of the tank vapor under the condition where the opening failure is detected.

With the above arrangement, under a situation where the canister check valve is closed and the purge gas flowing into the intake passage is limited to the gas flowing from the fuel tank, the fuel concentration of the purge gas can be appropriately set depending upon whether the gas consists solely of fuel vapor generated in the fuel tank, or the gas is a mixture of the fuel vapor and air. Thus, the system as described just above calculates the fuel injection amount based on the proper fuel concentration set in the above-described manner, and is thus able to achieve highly accurate air/fuel ratio control.

In one embodiment of any of the first, third and fifth aspects of the invention, the opening failure detecting unit detects the opening failure of the purge control valve immediately after the engine is started.

In the embodiment as described above, since an opening failure of the purge control valve is detected immediately after the engine is started, setting of the initial value of the correction factor and correction for reducing an amount of increase of the fuel injection amount during a cold start of the engine can be carried out immediately after uncontrollable purging of the canister due to the opening failure is started. Thus, the system according to the above embodiment of the invention can deal with abnormal conditions resulting from the opening failure of the purge control valve immediately after occurrence of these conditions, and is thus able to achieve highly accurate air/fuel ratio control.

BRIEF DESCRIPTION OF THE DRAWINGS

The foregoing and/or further objects, features and advantages of the invention will become more apparent from the following description of exemplary embodiments with reference to the accompanying drawings, in which like numerals are used to represent like elements and wherein.

DETAILED DESCRIPTION OF EXEMPLARY EMBODIMENTS

Figure 1:
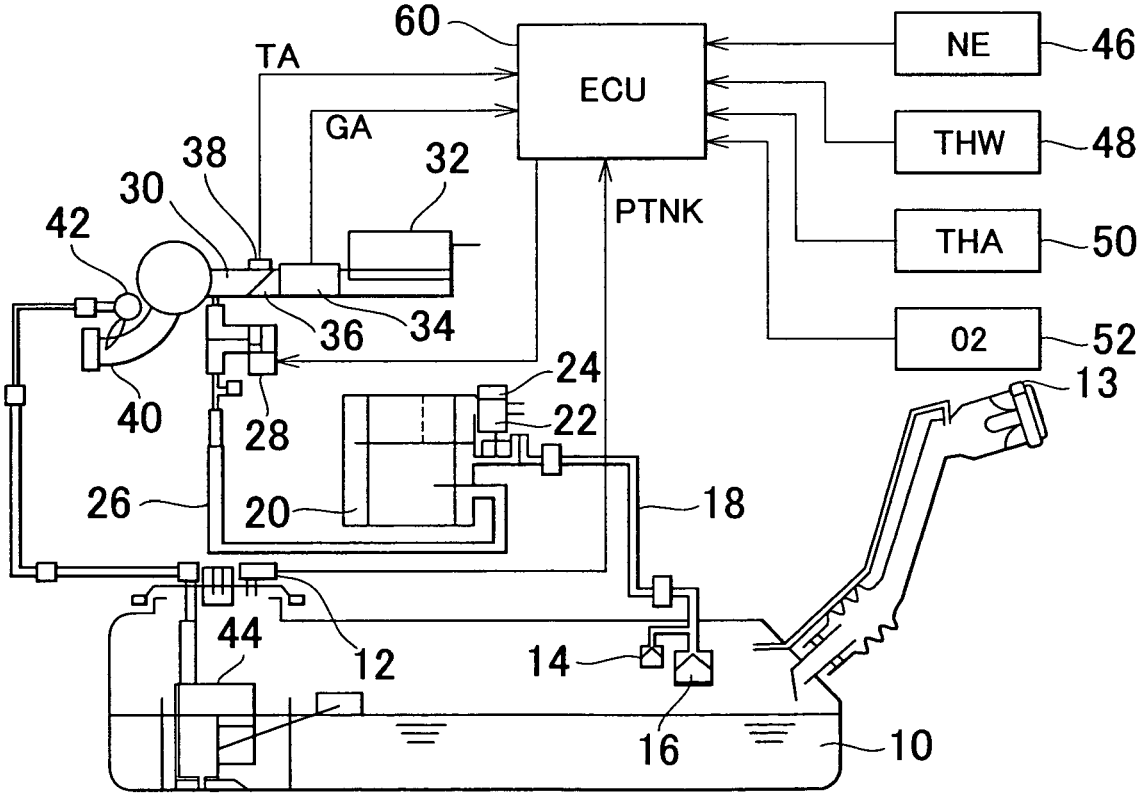
FIG. 1 is a view schematically showing the construction of an evaporative emission control system according to a first embodiment of the invention.

Some exemplary embodiments of the invention will be described in detail with reference to the drawings, in which the same reference numerals or symbols are used for identifying the corresponding elements or steps, of which detailed explanation will not be repeated.

First Embodiment

FIG. 1 shows the construction of an evaporative emission control system according to the first embodiment of the invention. The evaporative emission control system of this embodiment includes a fuel tank 10. The fuel tank 10 is provided with a tank pressure sensor 12 for measuring the pressure (tank pressure) PTNK in the fuel tank 10. A filler cap for closing a filler opening of the fuel tank 10 is provided with a check valve 13 that only allows flow of gas from the outside of the fuel tank 10 to the inside thereof. To the fuel tank 10 is connected one end of a vapor conduit 18 via roll over valves (ROV) 14, 16.

The other end of the vapor conduit 18 is connected to a canister 20. The canister 20 contains activated carbon, which adsorbs fuel vapors flowing from the fuel tank 10 through the vapor conduit 18. The canister 20 has an atmospheric vent in which a canister closed valve (CCV) 22 and a check valve 24 are disposed. The CCV 22 is a normally closed solenoid-operated valve that is opened when it receives a drive signal. The check valve 24 is a one-way valve that only allows flow of fluid from the atmosphere side (i.e., the outside) to the inside of the canister 20.

The valve opening pressure of the check valve 24 (i.e., the pressure at which the check valve 24 opens) is set to a larger value than the valve opening pressure of the check valve 13 disposed in the filler cap of the fuel tank 10. In the system of the present embodiment, therefore, when a vacuum is supplied to a system including the canister 20 and the fuel tank 10, the check valve 13 opens earlier than the check valve 24, and air flows into the fuel tank 10 first in the system.

To the canister 20 is also connected one end of a purge conduit 26. A purge vacuum switching valve (which will be called "purge VSV" when appropriate) 28 for controlling the amount of gas flowing through the purge conduit 26 is disposed at some midpoint in the purge conduit 26. The purge VSV 28 is a control valve adapted to be driven at a certain duty ratio to provide an opening angle that is substantially commensurate with the duty ratio.

The other end of the purge conduit 26 is connected to an intake passage 30 of the internal combustion engine. An air cleaner 32 is provided in an end portion of the intake passage 30. An airflow meter 34 that generates an output signal indicative of the air mass flow (i.e., the flow rate or specific volume of intake air, which may be simply called "intake air flow") GA is disposed downstream of the air cleaner 32. Furthermore, an electronic throttle valve 36 for controlling the intake air flow GA is disposed downstream of the airflow meter 34. A throttle sensor 38 that generates an output signal indicative of the throttle opening TA is disposed in the vicinity of the electronic throttle valve 36. The purge conduit 26 as described above is communicated to a certain point of the intake passage 30 downstream of the throttle valve 36.

The intake passage 30 communicates with the internal combustion engine (not shown) via an intake manifold 40. A fuel injector 42 for injecting fuel into the engine is disposed in each branch pipe of the intake manifold 40. In operation, fuel is supplied under a certain pressure from a fuel feed pump 44 disposed within the fuel tank 10 to the fuel injector 42. A fuel injection valve of the fuel injector 42 is opened in response to a signal to command opening of the valve, to eject fuel in an amount commensurate with a period or duration (valve opening duration) for which the valve is opened. Thus, the amount of fuel injected into the engine can be controlled by varying the valve opening duration (which may also be called "fuel injection time TAU") of the fuel injector 42.

The internal combustion engine incorporates various sensors, such as an engine speed sensor 46, a water temperature sensor 48, an intake air temperature sensor 50 and an oxygen sensor 52. The engine speed sensor 46 generates an output signal indicative of the engine speed NE. The water temperature sensor 48 generates an output signal indicative of the coolant temperature THW of the engine. The intake air temperature sensor 50 generates an output signal indicative of the temperature of intake air flowing in the intake passage 30. The oxygen sensor 52 is disposed in an exhaust passage of the engine, and generates an output signal that indicates whether exhaust gas flowing into a catalyst (not shown) is lean (i.e., contains oxygen) or rich (i.e., contains no oxygen).

The system of the present embodiment has an electronic control unit (ECU) 60. Various sensors including those as indicated above and actuators are connected to the ECU 60. The ECU 60 performs various calculations or computing based on the outputs of these sensors, and executes control of the CCV 22, purge VSV 28, fuel injectors 42, and so on.

Operations of the System

1. Basic Operations

In the system of the present embodiment, the CCV 22 is held in an open state and the purge VSV 28 is held in a closed state while the engine is stopped and while refueling is conducted. In this condition, the canister 20 can adsorb fuel vapor flowing from the fuel tank 10. During an operation of the engine, this system drives the purge VSV 28 at a suitable duty ratio while keeping the CCV 22 in the open state. With this control, air is introduced through the CCV 22 to purge the canister 20 of the fuel vapor, so that purge gas is drawn into the intake passage 30 of the engine in an amount commensurate with the drive duty ratio of the purge VSV 28. Thus, the system of the present embodiment is able to dispose of the fuel vapor generated in the fuel tank 10 by burning it as fuel, without allowing the fuel vapor to escape to the atmosphere.

2. Determination of Opening Failure of Purge VSV

The system of the present embodiment fails to perform the basic operations as described above if an opening failure occurs in the purge VSV 28, namely, if the purge VSV 28 is stuck in the open state or position. It is thus desirable to detect the opening failure of the purge VSV 28 immediately after its occurrence. To this end, the system of this embodiment is adapted to determine whether an opening failure occurs in the purge VSV 28 immediately after the engine is started. If an opening failure of the purge VSV 28 is detected, the system is arranged to take measures to reduce or suppress influences of the opening failure soon after the detection thereof.

Figure 2:
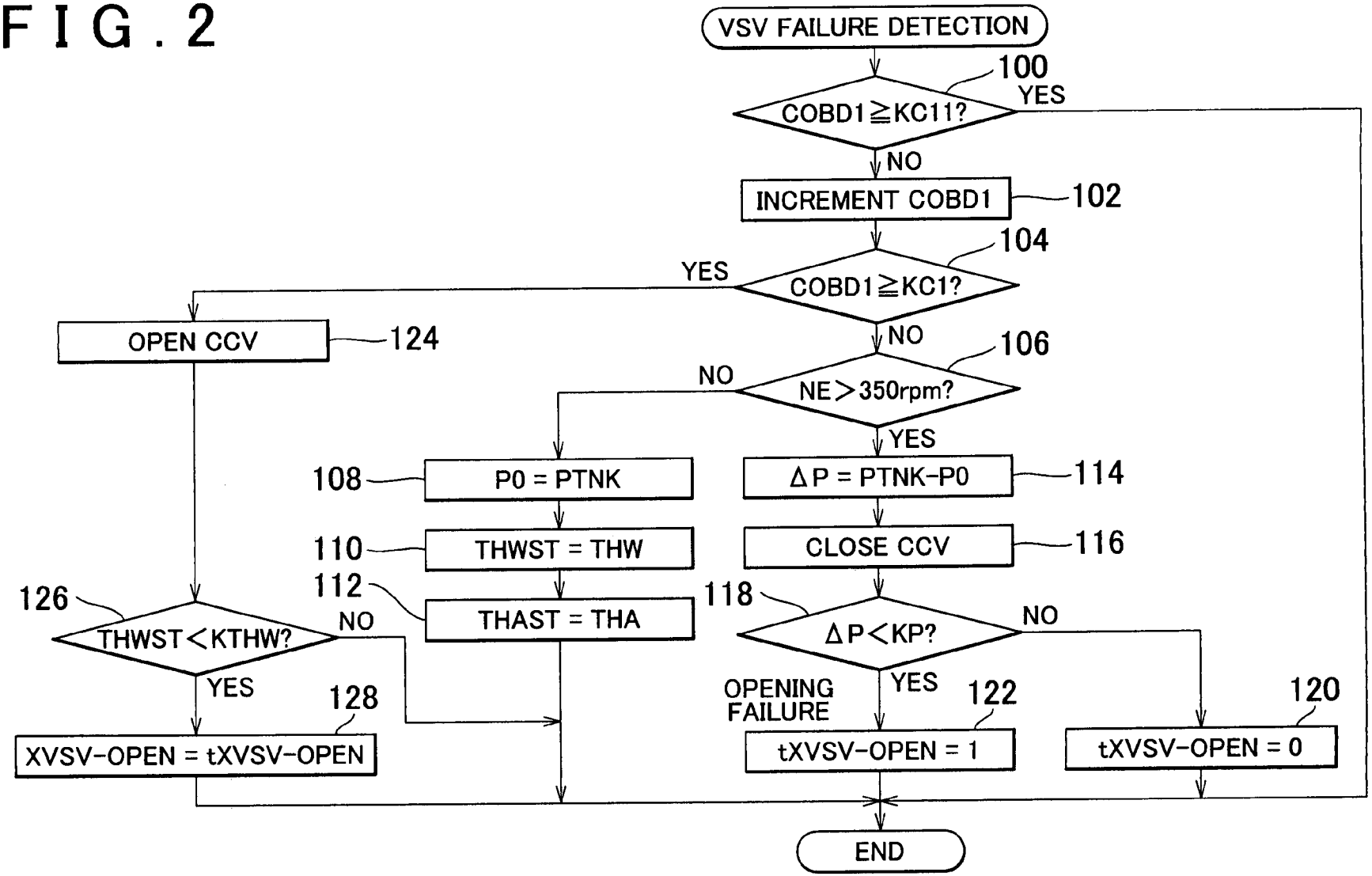
FIG. 2 is a flowchart showing a control routine executed in the first embodiment of the invention to determine whether an opening failure occurs in a purge VSV.

FIG. 2 is a flowchart showing a control routine executed by the system of the present embodiment for diagnosing an opening failure of the purge VSV 28. The routine shown in FIG. 2 is started at the same time that the ignition switch of the vehicle is turned ON, and is then repeatedly executed at certain time intervals.

In the routine shown in FIG. 2, it is determined in step S100 whether a counter value COBD1 of a first OBD counter has reached a jump determination value KC11. The first OBD counter is cleared through an initialization process when the ignition switch of the vehicle is turned ON. Immediately after the vehicle is started, it is determined in step S100 that COBD1≧KC11 is not satisfied, namely, the counter value COBD1 has not reached the jump determination value KC11.

If step S100 determines that COBD1≧KC11 is not satisfied, the counter value COBD1 of the first OBD counter is incremented in step S102. Subsequently, it is determined in step S104 whether the counter value COBD1 has reached a diagnosis determination value KC1. The diagnosis determination value KC1, which corresponds to the timing of determination as to whether an opening failure occurs in the purge VSV 28, is smaller by 1 than the above-indicated jump determination value KC11. Immediately after the vehicle is started, step S104 determines that COBD1≧KC1 is not satisfied, namely, the counter value COBD1 has not reached the diagnosis determination value KC1.

If step S104 determines that COBD1≧KC1 is not satisfied, it is then determined in step S106 whether the engine speed NE has exceeded 350 rpm. Here, 350 rpm is a criteria value used for determining whether the engine has entered the stage of complete combustion. Immediately after the engine is started, for example, during a cranking period of the engine, the condition that NE>350 rpm is not satisfied. In this case, the tank pressure PTNK measured at this point in time is stored as a reference pressure P0 in step S108. Then, the coolant temperature THW and the intake air temperature THA measured at this point in time are stored as an initial coolant temperature THWST and an initial intake air temperature THAST in step S110 and step S112, respectively. After execution of step S112, the current cycle of the control routine is finished.

After the start of the engine, the process of steps S100–S112 as described above is repeatedly performed each time the routine shown in FIG. 2 is executed until the engine speed NE reaches 350 rpm. Consequently, the ECU 60 stores the tank pressure PTNK measured at a point in time when the engine speed NE reaches 350 rpm as the reference pressure P0, and stores the coolant temperature THW and intake air temperature THA measured at this time point as the initial coolant temperature THWST and the initial intake air temperature THAST, respectively.

If the routine shown in FIG. 2 is executed after the engine speed NE reaches 350 rpm, namely, after the engine enters the stage of complete combustion, it is determined in step S106 that NE>350 rpm is satisfied. In this case, a pressure difference ΔP (=PTNK−P0) between the tank pressure PTNK measured at this point in time and the reference pressure P0 is then calculated in step S114. The thus calculated value of the pressure difference ΔP is in the vicinity of zero when the tank pressure PTNK is not significantly reduced after complete combustion of the engine, and becomes a negative value when the tank pressure PTNK is significantly reduced.

In the routine shown in FIG. 2, step S114 is followed by step S116 in which the CCV 22 is closed. It is then determined in step S118 whether the pressure difference ΔP is smaller than an opening failure determination value KP. Namely, it is determined whether a significant reduction in the tank pressure PTNK takes place after the engine enters the stage of complete combustion. If step S118 determines that ΔP<KP is not satisfied, the ECU 60 judges that the intake manifold vacuum has no influence on the tank pressure PTNK. In this case, 0 is set to an opening failure provisional determination flag tXVSV-OPEN in step S120 so as to indicate that an opening failure of the purge VSV 28 is not recognized at this point in time. If step S118 determines that ΔP<KP is satisfied, on the other hand, the intake manifold vacuum has an influence on the tank pressure PTNK. Namely, the ECU 60 judges that the purge VSV 28 is open. In this case, 1 is set to the opening failure provisional determination flag tXVSV-OPEN in step S122 so as to indicate that an opening failure of the purge VSV 28 is recognized or found.

During a period from the time when the engine enters the complete combustion stage to the timing of determination as to whether an opening failure occurs in the purge VSV 28, namely, until the counter value COBD1 of the first OBD counter reaches the diagnosis determination value KC1, the process of steps S100–S106 and steps S114–S122 as described above is repeated each time the routine shown in FIG. 2 is executed. As a result, the final value of the opening failure provisional determination flag tXVSV-OPEN is set in the control cycle immediately before COBD1 reaches KC1.

If step S104 determines that COBD1≧KC1 is satisfied after the start of the routine shown in FIG. 2, the ECU 60 judges that the time has come when the presence or the absence of an opening failure should be determined. In this case, the CCV 22 is opened in step S124, and it is determined in step S126 whether the initial coolant temperature THWST is lower than a cold-start criteria value KTHW.

The cold-start criteria value KTHW is a criteria value used for determining whether there is a possibility of generation of a large amount of fuel vapor in the fuel tank 10. If it is determined that the initial coolant temperature THWST is not lower than KTHW (i.e., if a negative determination is made in step S126), the ECU 60 judges that there is a possibility of generation of a large amount of fuel vapor in the fuel tank 10 when the engine is started. In this situation, the pressure difference ΔP may be influenced by the fuel vapor generated in the fuel tank 10, and an error is likely to occur in the determination made on the basis of the pressure difference ΔP. In the routine shown in FIG. 2, therefore, if step S126 determines that THWST<KTHW is not satisfied, namely, THWST is equal to or larger than KTHW, the ECU 60 finishes the current cycle of the control routine without making a final determination concerning an opening failure of the purge VSV 28. With this process, an erroneous determination on the presence of an opening failure of the purge VSV 28 is prevented from being made, for example, when the engine is re-started in warm conditions.

If step S 126 determines that THWST<KTHW is satisfied, namely, the initial coolant temperature THWST is lower than the criteria value KTHW, the ECU 60 judges that the pressure difference ΔP is not significantly influenced by the fuel vapor in the fuel tank 10. In this case, the value of the opening failure provisional determination flag tXVSV-OPEN is set as a value of an opening failure determination flag XVSV-OPEN in step S128. Thereafter, the ECU 60 determines that an opening failure occurs in the purge VSV 28 if the flag XVSV-OPEN is set at 1, and that no opening failure occurs in the purge VSV 28 if the flag XVSV-OPEN is set at 0.

When the routine shown in FIG. 2 is executed again after the above-described series of operations are finished, it is determined in step S100 that COBD1≧KC11 (=KC1+1) is satisfied. In this case, the ECU 60 skips step S102 and subsequent steps, and finishes the routine of FIG. 2 without performing any substantial process. In the present embodiment, the ECU 60 can accurately determine whether an opening failure occurs in the purge VSV 28 immediately after the start of the engine, by executing the routine of FIG. 2 as explained above.

If an opening failure occurs in the purge VSV 28, the system of the present embodiment cannot control the opening angle of the purge VSV 28, and cannot control the amount QPG of flow of purge gas (which may be called "purge gas flow QPG" when appropriate") during an operation of the engine. In the following, a phenomenon that appears because the purge gas flow QPG is uncontrollable, and the content of a measure taken by the system of the present embodiment to deal with the phenomenon will be described.

3. Phenomenon due to Opening Failure of Purge VSV

Figure 3:
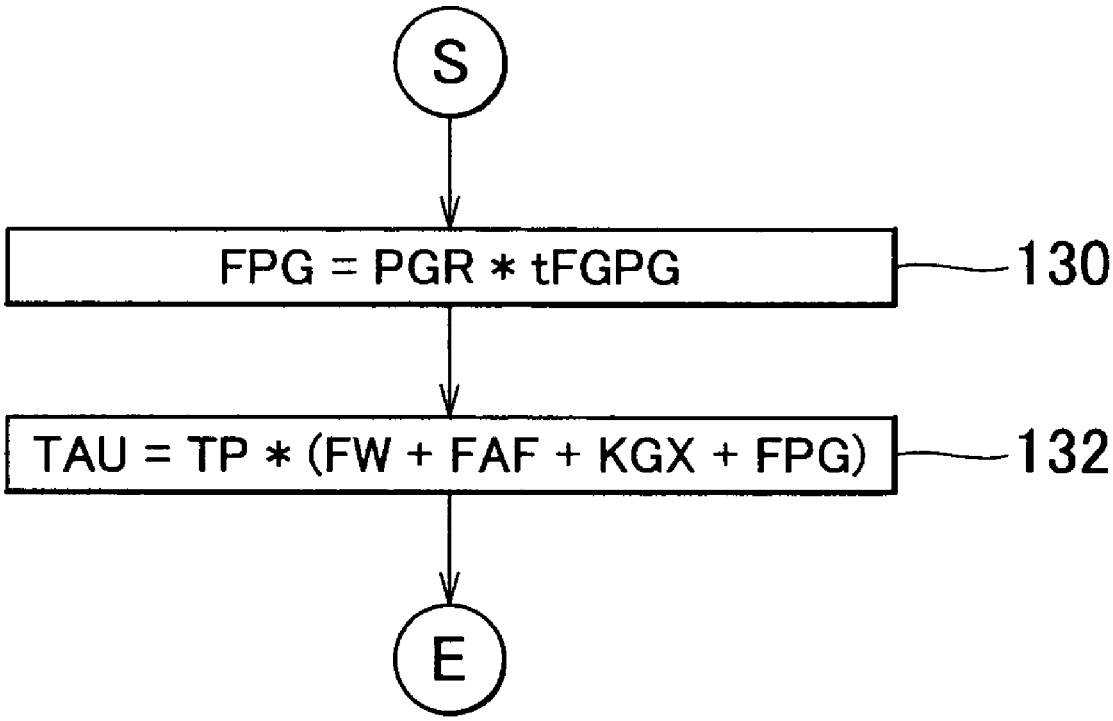
FIG. 3 is a flowchart explaining a method of calculating a fuel injection time, which method is used in the first embodiment of the invention.

FIG. 3 is a flowchart explaining a method by which the ECU 60 calculates the fuel injection time TAU according to the present embodiment. As shown in FIG. 3, the ECU 60 initially calculates a purge correction factor FPG in step S130 according to the following expression (1) in the process of calculating the fuel injection time TAU.

$$FPG=tFGPG\times PGR \quad (1)$$

In the above expression (1), PGR is purge ratio that means the ratio of the purge gas flow QPG to the intake air flow GA, i.e., (QPG/GA)×100, and tFGPG is vapor concentration learned value stored in RAM, which means the proportion of correction of TAU per 1% of the purge ratio, or physically means the fuel concentration of the purge gas.

Next, the ECU 60 calculates the fuel injection time TAU in step S132 according to the following expression (2).

$$TAU=TP\times(FW+FAF+KGX+FPG) \quad (2)$$

In the above expression (2), TP is the basic fuel injection time for achieving the target air/fuel ratio, which time is calculated in relation to the intake air flow GA, and FW is a water temperature factor used in correction of TP for increasing the fuel injection amount during a cold start of the engine. FAF is an air/fuel ratio feedback factor that is increased or reduced based on the output of the oxygen sensor 52 so that the exhaust air/fuel ratio approaches the target air/fuel ratio. KGX is a learned value that absorbs influences of chronological changes of the engine, and the like. The learned value KGX is a factor that is learned in association with each of a plurality of engine operating regions established on the basis of the intake air flow GA, and "X" affixed to "KG" represents the operating region. FPG included in the above expression (2) is the purge correction factor calculated in the above step S130.

As explained above with reference to the expression (1), the purge correction factor FPG is determined by the purge ratio PGR and the vapor concentration learned value FGPG, and the purge ratio PGR is determined by the intake air flow GA and the purge gas flow QPG, as described above. The intake air flow GA varies with time depending upon the operating conditions of the engine, and can be detected by the airflow meter 34. On the other hand, the purge gas flow QPG, which is the amount of gas passing through the purge VSV 28 and flowing into the intake passage 30, is determined by the opening angle of the purge VSV 28 and the intake pipe pressure PM. The intake pipe pressure PM varies with time depending upon the operating conditions of the engine, and can be estimated based on, for example, the intake air flow GA or the throttle opening TA. In the meantime, the opening angle of the purge VSV 28 is determined by the drive duty DPG of the purge VSV 28 when the purge VSV 28 is normal. Accordingly, the purge ratio PGR can be properly controlled by controlling the drive duty DPG of the purge VSV 28. In step S130, the purge correction factor FPG is calculated according to the above expression (1), based on the thus controlled PGR.

The ECU 60 constantly performs a process of learning the vapor concentration learned value FGPG when purge gas flows in the system. In step S130, the purge correction factor FPG is calculated by substituting the vapor concentration learned value FGPG into the above-indicated expression (1). In the following, a method by which the ECU 60 learns the vapor concentration learned value FGPG will be explained.

As is understood from the above expression (2), the ECU 60 calculates the fuel injection time TAU by adjusting the basic fuel injection time TP to reflect the air/fuel ratio feedback factor FAF. The air/fuel ratio feedback factor FAF is updated to be reduced when the exhaust air/fuel ratio is rich, and is updated to be increased when the exhaust air/fuel ratio is lean. Accordingly, when the influence of the purge gas is not sufficiently absorbed by the purge correction factor FPG, the air/fuel ratio feedback factor FAF shifts or deviates from a reference value to the rich side or the lean side.

If a significant deviation of the air/fuel ratio feedback factor FAF is found while purge gas is flowing in the system, the ECU 60 updates the vapor concentration learned value FGPG on the assumption that the deviation is caused by an influence of the purge gas. More specifically, if the air/fuel ratio feedback factor FAF shows a significantly shift or deviation to the richer side (i.e., in the direction to reduce TP), the ECU 60 judges that the actual purge gas concentration is higher than that represented by the current vapor concentration learned value FGPG, and updates FGPG to represent the higher concentration. If the air/fuel ratio feedback factor FAF shows a significant shift to the leaner side (i.e., in the direction to increase TP), on the other hand, the ECU 60 judges that the actual purge gas concentration is lower than that represented by the current vapor concentration learned value FGPG, and updates FGPG to represent the lower concentration. With the learning process as described above, the vapor concentration learned value FGPG can be matched with the actual purge gas concentration, and the influence of the purge gas can be ultimately absorbed only by the purge correction factor FPG.

As described above, the system of the present embodiment performs learning of the vapor concentration learned value FGPG by utilizing the fact that while purge gas is flowing in the system, the exhaust air/fuel ratio shifts to the rich side or lean side due to the influence of the purge gas, and consequently the air/fuel ratio feedback factor FAF shifts or deviates from the reference value. Until the vapor concentration learned value FGPG matches the actual purge gas concentration, the system utilizes its function of air/fuel ratio feedback control so as to keep the exhaust air/fuel ratio in the vicinity of the target air/fuel ratio.

In the meantime, the air/fuel ratio feedback factor FAF is basically updated in steps of a certain amount or width, solely based on the determination as to whether the exhaust air/fuel ratio is rich or lean. Namely, the speed of updating the air/fuel ratio feedback factor FAF is constant irrespective of the degree of deviation of the actual air/fuel ratio from the target air/fuel ratio. It is thus desirable for learning of the vapor concentration learned value FGPG to proceed without permitting the actual air/fuel ratio to largely deviate from the target air/fuel ratio. To meet this requirement, the system needs to reduce the purge gas flow QPG under a situation where learning of FGPG has not proceeded to a sufficient extent, so as to reduce the deviation of the air/fuel ratio due to an influence of the purge gas. Thus, the system of the present embodiment is arranged to reduce the purge gas flow QPG to a sufficiently small amount under a situation where the vapor concentration learned value FGPG has not been learned sufficiently, for example, immediately after, the engine is started, and then increase the purge gas flow QPG as leaning of FGPG proceeds.

However, when an opening failure occurs in the purge VSV 28, the purge gas flow QPG cannot be controlled, and a large amount of purge gas starts flowing in the system immediately after the engine is started. In this case, if learning of the vapor concentration learned value FGPG is performed by a normal or known method, the actual air/fuel ratio may be kept largely deviating from the target air/fuel ratio over a long period of time. In view of this situation, when an opening failure of the purge VSV 28 is found, the system of the present embodiment determines only the direction of deviation of the air/fuel ratio after the purge gas starts flowing, and gives a large change in that direction to the vapor concentration learned value FGPG. With this arrangement, the speed of learning of the vapor concentration learned value FGPG can be increased, and, consequently, the accuracy of the air/fuel ratio control can be improved.

Figure 4:
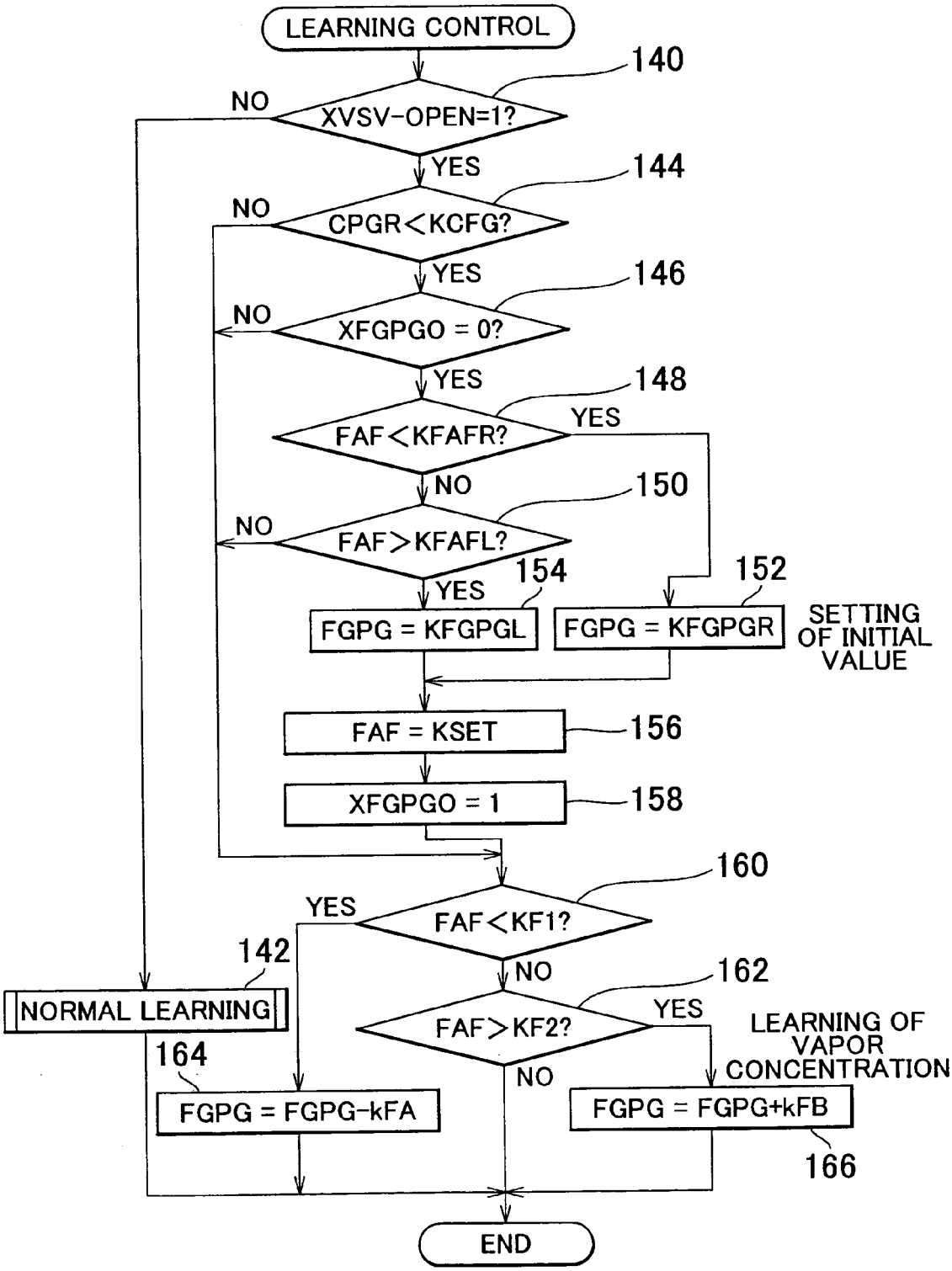
FIG. 4 is a flowchart of a learning control routine executed in the first embodiment of the invention.

FIG. 4 is a flowchart showing a learning control routine executed by the ECU 60 for performing learning of the vapor concentration learned value FGPG. The ECU 60 can accomplish the above-described function by executing this routine. In the routine shown in FIG. 4, it is initially determined in step S140 whether the opening failure determination flag XVSV-OPEN is set at 1. If step S140 determines that XVSV-OPEN=1 is not satisfied, the ECU 60 judges that no opening failure occurs in the purge VSV 28. In this case, learning of the vapor concentration learned value FGPG is carried out by the normal method in step S142. The process performed in step S142 is substantially the same as the process of steps S160–S166 as described later.

If step S140 determines that XVSV-OPEN=1 is satisfied, on the other hand, the ECU 60 judges that an opening failure occurs in the purge VSV 28. In this case, it is then determined in step S144 whether the counter value CPGR of a purge counter is smaller than a criteria value KCFG. The purge counter is a counter for counting a period of time for which purge gas flows in the system. When an opening failure occurs in the purge VSV 28, purge gas starts flowing at the same time that the engine is started. In this case, therefore, CPGR represents a period of time that has passed after the start of the engine. The criteria value KCFG corresponds to a period during which it is determined whether a significant deviation has appeared in the air/fuel ratio due to the opening failure of the purge VSV 28. If it is determined in step S144 that CPGR is not smaller than the criteria value KCFG, namely, CPGR is already equal to or larger than the criteria value KCFG, the process of steps S146–S158 is skipped, and the process of step S160 and subsequent steps is immediately carried out.

If it is determined in step S144 that CPGR<KCFG is satisfied, on the other hand, it is then determined in step S146 whether an initial value setting flag XFGPG0 is equal to 0. If it is determined that XFGPG0=0 is not satisfied, namely, XFGPG0 is equal to 1, the ECU 60 judges that the initial value associated with the opening failure of the purge VSV 28 has already been set to the vapor concentration learned value FGPG. In this case, there is no need to perform the process of steps S148–S158, and the process of step S160 and subsequent steps is immediately carried out. If it is determined that XFGPG0=0 is satisfied, it is then determined in step S148 whether the air/fuel ratio feedback factor FAF is smaller than a significant rich determination value KFAFR.

The significant rich determination value KFAFR is a criteria value used for determining whether the air/fuel ratio has shifted to the rich side. In the present embodiment, the system is arranged to determine that purge gas having a high fuel concentration flows in the system and the vapor concentration learned value FGPG needs to be rapidly updated to the rich side in the case where the air/fuel ratio feedback factor FAF has been updated to a value that is below the significant rich determination value KFAFR by the time when the counter value CPGR of the purge counter reaches the criteria value KCFG. If step S148 determines that FAF<KFAFR is not satisfied, namely, FAF is equal to or larger than KFAFR, the ECU 60 judges that the need to update FGPG to the rich side has not been found. In this case, it is then determined in step S150 whether the air/fuel ratio feedback factor FAF is larger than a significant lean determination value KFAFL.

The significant lean determination value KFAFL is a criteria value used for determining whether the air/fuel ratio has shifted to the lean side. In the present embodiment, the system is arranged to determine that purge gas having a low fuel concentration flows in the system and the vapor concentration learned value FGPG needs to be rapidly updated to the lean side in the case where the air/fuel ratio feedback factor FAF has been updated to a value that exceeds the significant lean determination value KFAFL by the time when the counter value CPGR of the purge counter reaches the criteria value KCFG. If step S150 determines that FAF>KFAFL is not satisfied, namely, FAF is equal to or smaller than KFAFL, the ECU 60 judges that the need to update FGPG to the lean side has not been found. In this case, the process of step S160 and subsequent steps is immediately carried out.

If step S148 determines that FAF<KFAFR is satisfied, on the other hand, the ECU 60 judges that the vapor concentration learned value FGPG needs to be rapidly updated to the rich side, and a rich-side initial value KFGPGR is set as the initial value of FGPG in step S152. If step S150 determines that FAF>KFAFL is satisfied, the ECU 60 judges that the vapor concentration learned value FGPG needs to be rapidly updated to the lean side, and a lean-side initial value KFGPGL is set as the initial value of FGPG in step S154.

The rich-side initial value KFGPGR and the lean-side initial value KFGPGL are set so as to absorb the amount of shift or deviation KFAFR or KFAFL of the air/fuel ratio feedback factor FAF. Therefore, when the initial value KFGPGR or KFGPGL is set to the vapor concentration learned value FGPG, it is necessary to clear or eliminate the deviation of the air/fuel ratio feedback factor FAF. To this end, in the routine shown in FIG. 4, step S152 or step S154 is followed by step S156 in which FAF is returned to the basic value KSET. After execution of step S156, the initial value setting flag XFGPG0 is set at 1 in step S158 so as to indicate that setting of the initial value of the vapor concentration learned value FGPG is finished.

In the routine shown in FIG. 4, when it is determined that the condition of step S144 (CPGR<KCFG), or the condition of step S146 (XFGPG0=0), or the condition of step S150 (FAF>KFAFL) is not satisfied, and when the process of step S158 is finished, a process similar to the normal learning process is carried out. In this process, it is determined in step S160 whether the air/fuel ratio feedback factor FAF is smaller than a normal rich determination value KF1. If it is determined that FAF<KF1 is not satisfied, namely, FAF is equal to or larger than KF1, it is determined in step S162 whether FAF is larger than a normal lean determination value KF2.

If it is determined that FAF>KF2 is not satisfied, namely, FAF is equal to or smaller than KF2, the ECU 60 judges that the air/fuel ratio feedback factor FAF is kept in the vicinity of the reference value. In this case, the ECU 60 judges that the current vapor concentration learned value FGPG matches the actual purge gas concentration, and the fuel injection time can be appropriately corrected by using the purge correction factor FPG. In this case, the ECU 60 immediately finishes the current control cycle without performing the process of updating FGPG.

If step S160 determines that FAF<KF1 is satisfied, the ECU 60 judges that the air/fuel ratio is shifted to the rich side, and the vapor concentration learned value FGPG needs to be updated to the rich side. In this case, the ECU 60 reduces FGPG by a predetermined update amount kFA in step S164, and then finishes the current control cycle. If step S162 determines that FAF>KF2 is satisfied, the ECU judges that the vapor concentration learned value FGPG needs to be updated to the lean side. In this case, the ECU 60 increases FGPG by a predetermined update amount kFB in step S166, and then finishes the current control cycle.

Through the process of setting the vapor concentration learned value FGPG at the initial value KFGPGR or KFGPGL in the above step S152 or S154, each of the rich-side initial value KFGPGR and the lean-side initial value KFGPGL can give a larger change to FGPG than the update amount (that is equal to kFA or kFB) used in the normal learning process. Also, the rich-side initial value KFGPGR and the lean-side initial value KFGPGL are both set in view of the concentration of purge gas that is likely to appear immediately after the engine is started. Thus, the process of step S152 or S154 makes it possible to make FGPG close to a value that matches the actual purge gas concentration at a higher speed as compared with the normal learning process.

In the process of setting the initial value as described above, the process of step S148 or step S150, namely, the process of determining whether the air/fuel ratio has shifted to the rich side or lean side, is arranged to determine the occurrence of the shift (i.e., the presence of a significant deviation) with higher sensitivity than that in the normal learning process. More specifically, the significant rich determination value KFAFR used in step S148 is set at a larger value than the criteria value (equal to the normal rich determination value KF1) used for determining a shift of FAF to the rich side in the normal learning process. On the other hand, the significant lean determination value KFAFL used in step S148 is set at a smaller value than the criteria value (equal to the normal lean determination value KF2) used for determining a shift of FAF to the lean side in the normal learning process. Thus, according to the routine shown in FIG. 4, the ECU 60 can quickly determine the direction of shift or deviation of the air/fuel ratio after purging caused by an opening failure of the purge VSV 28 is started, and can quickly set FGPG at an appropriate one of the initial values KFGPGR and KFGPGL depending upon the direction of shift or deviation.

According to the routine shown in FIG. 4, when an opening failure occurs in the purge VSV 28, a shift or deviation of the air/fuel ratio can be determined with higher sensitivity than that in the case of the normal learning process, and the vapor concentration learned value FGPG can be rapidly set at the initial value KFGPGR or KFGPGL; as explained above. Thus, according to the routine shown in FIG. 4, FGPG can be made close to a value that matches the actual purge gas concentration at a sufficiently high speed as compared with the case where the normal learning process is performed. If FGPG matches the actual purge gas concentration, the fuel injection time can be appropriately corrected by using the purge correction factor FPG, and therefore fluctuations in the air/fuel ratio due to influences of the purge gas can be reduced or suppressed irrespective of the purge gas flow QPG. Thus, the system of the present embodiment is able to achieve highly accurate air/fuel ratio control even under a situation where a large amount of purge gas flows into the engine (i.e., the purge gas flow QPG is large) because of the opening failure of the purge VSV 28.

In the first embodiment as described above, the purge VSV 28 corresponds to the "purge control valve" mentioned above in "SUMMARY OF INVENTION", and the vapor concentration learned value FGPG corresponds to the above-mentioned "correction factor". A portion of the ECU 60 that updates the air/fuel ratio feedback factor FAF under a situation where purge gas flows in the system provides the above-mentioned "air/fuel ratio deviation detecting unit", and a portion of the ECU 60 that calculates the fuel injection time TAU by the method shown in FIG. 3 provides the above-mentioned "fuel injection amount calculating unit". A portion of the ECU 60 that executes steps S160–S166 of FIG. 4 or a process similar to the process of steps S160–S166 in the normal learning process provides the above-mentioned "correction factor updating unit", a portion of the ECU 60 that executes step S140 of FIG. 4 provides the above-mentioned "opening failure detecting unit", a portion of the ECU 60 that executes steps S148 and S150 provides the above-mentioned "deviating condition determining unit", and a portion of the ECU 60 that executes steps S152 and S154 provides the above-mentioned "initial value setting unit". Also, in the first embodiment, the condition used in steps S160 and S162 corresponds to the above-mentioned "first condition", and the condition used in steps S148 and S150 corresponds to the above-mentioned "second condition".

Second Embodiment

Figure 5:
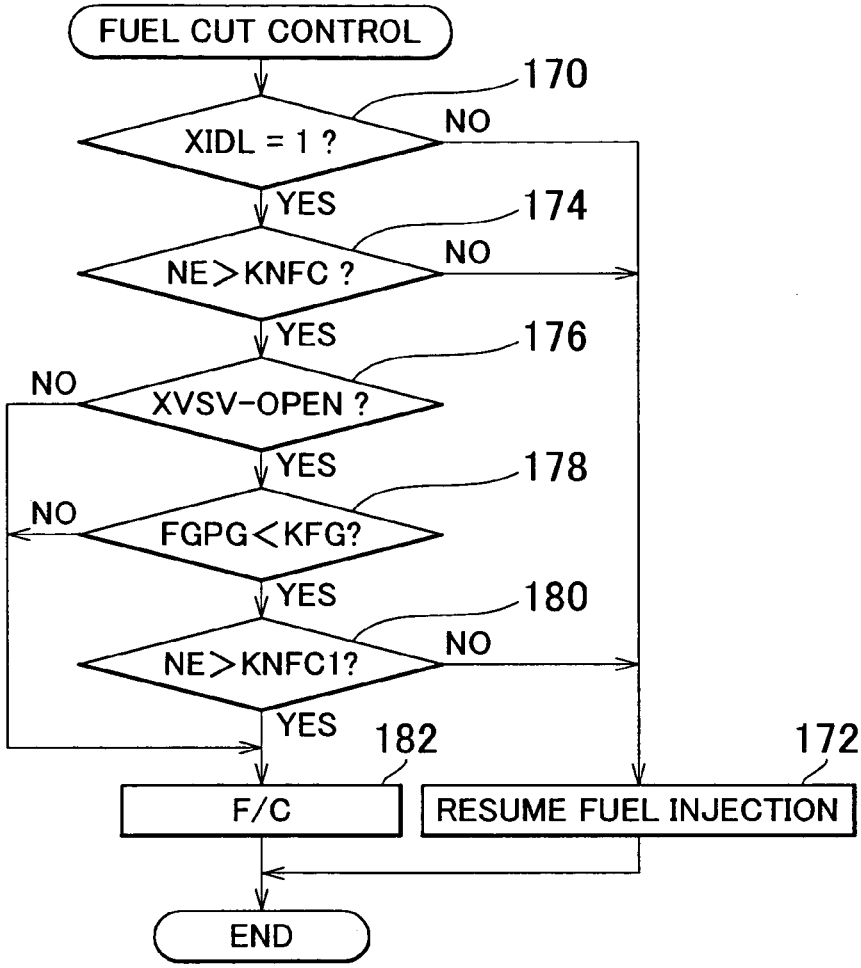
FIG. 5 is a flowchart of a fuel-cut (F/C) control routine executed in a second embodiment of the invention.

Referring next to FIG. 5, the second embodiment of the invention will be described. The system of this embodiment is similar in construction to that of the first embodiment, and is characterized in that the ECU 60 executes a control routine shown in FIG. 5 as described later, in addition to or in place of the above-described routine shown in FIG. 4.

When the accelerator pedal is released and the engine speed NE is sufficiently high, fuel cut (F/C) control is performed in which fuel injection in the engine is stopped. When the canister 20 is to be purged of fuel vapor, the ECU 60 checks if the fuel cut (F/C) control is being executed, and drives the purge VSV 28 at a suitable duty ratio as long as the fuel cut (F/C) control is not performed. Accordingly, when the purge VSV 28 is normal, no purge gas flows in the system during execution of the fuel cut (F/C) control, thus avoiding a situation where only the fuel contained in the purge gas is supplied into each cylinder of the engine.

However, when an opening failure occurs in the purge VSV 28, flow of the purge gas cannot be controlled, and therefore purge gas flows into the intake passage 30 even during the fuel cut (F/C) control. In this case, an air-fuel mixture drawn into the engine has an extremely low fuel concentration, and may cause a misfire in the cylinder. If the mixture is not normally burned in the cylinder, the resulting gas containing a large amount of unburned components flows into the catalyst where the gas is burned while damaging the catalyst. In order to prevent the catalyst from being damaged, the system of the present embodiment restricts execution of the fuel cut (F/C) control when the purge VSV 28 suffers an opening failure.

FIG. 5 is a flowchart showing a F/C control routine executed by the ECU 60 for accomplishing the above-described function. In the routine shown in FIG. 5, it is determined in step S170 whether an idle flag XIDL is set at 1. The idle flag XIDL is set at 1 when the accelerator pedal is released during an operation of the engine. If it is determined that XIDL=1 is not satisfied, the ECU 60 judges that the accelerator pedal is depressed by the driver of the vehicle. In this case, the engine resumes a normal operating state involving fuel injection (or the engine is kept in the normal operating state if it is not under fuel cut control) in step S172, and the current cycle of the control routine is finished.

If step S170 determines that XIDL=1 is satisfied, on the other hand, it is then determined in step S174 whether the engine speed NE is higher than a normal-mode fuel cut speed KNFC. The normal-mode fuel cut speed KNFC is an engine speed (e.g., 1000 rpm) as a criterion for determining whether fuel cut (F/C) control can be executed, which is set assuming that the purge VSV 28 is normal. If it is determined that NE>KNFC is not satisfied, the ECU 60 judges that the engine speed NE is not high enough to require execution of the fuel cut control. In this case, the ECU 60 executes step S172 as described above, and finishes the current cycle of the routine.

If step S174 determines that NE>KNFC is satisfied, on the other hand, it is then determined in step S176 whether the opening failure determination flag XVSV-OPEN is set at 1. If it is determined that XVSV-OPEN=1 is not satisfied, the ECU 60 judges that no opening failure occurs in the purge VSV 28. In this case, the ECU 60 judges that there is no need to restrict execution of the fuel cut control, and immediately executes step S182, namely, executes the fuel cut control.

If step S176 determines that XVSV-OPEN=1 is satisfied, it is then determined in step S178 whether the vapor concentration learned value FGPG is smaller than a predetermined criteria value KFG. If the fuel concentration of the purge gas is sufficiently low, no damage is done to the catalyst even if the fuel cut control is performed while the purge gas is flowing. In this case, it is not necessary to restrict execution of the fuel cut control. Thus, the determination as to whether FGPG<KFG is satisfied is physically equivalent to a determination as to whether the fuel concentration of the purge gas is high enough to require restriction of the fuel cut control. If it is determined that FGPG<KFG is not satisfied, the ECU 60 judges that there is no need to restrict execution of the fuel cut control, and immediately executes step S182.

If it is determined that FGPG<KFG is satisfied, on the other hand, the ECU 60 judges that execution of the fuel cut control should be restricted. In this case, the ECU 60 determines in step S180 whether the engine speed NE is higher than a failure-mode fuel cut speed KNFC1. If it is determined that NE>KNFC1 is not satisfied, namely, NE is equal to or lower than KNFC1, the ECU 60 executes step S172 as described above while inhibiting execution of the fuel cut control. If it is determined that NE>KNFC1 is satisfied, on the other hand, step S182 is executed to perform the fuel cut control.

The failure-mode fuel cut speed KNFC1 used in the above step S180 is set at a value (e.g., 2000 rpm) that is higher than the normal-mode fuel cut speed KNFC. Thus, according to the routine shown in FIG. 5, when an opening failure occurs in the purge VSV 28 and the fuel concentration of the purge gas is sufficiently high, the range of execution of the fuel cut control (i.e., the engine speed range that permits execution of the fuel cut control) is limited to a higher speed range than that in the case where the purge VSV 28 is normal. Thus, the system of the present embodiment is able to sufficiently suppress or prevent damage of the catalyst due to the opening failure of the purge VSV 28 while maintaining an effect of reducing wasteful fuel consumption through the fuel cut control.

In the second embodiment as described above, execution of the fuel cut control is restricted by using the failure-mode fuel cut speed when the purge VSV 28 suffers an opening failure, which speed is higher than the normal-mode fuel cut speed used where the purge VSV 28 is normal. However, the method of restricting execution of the fuel cut control is not limited to this method. For example, when an opening failure occurs in the purge VSV 28 and the fuel concentration of the purge gas is sufficiently high, the ECU 60 may always inhibit execution of the fuel cut control without comparing the engine speed NE with the fuel cut speed. In this case, flow of gas containing unburned components into the catalyst can be prevented with higher reliability, and damage to the catalyst can be further reduced.

In the second embodiment as described above, the purge VSV 28 corresponds to the "purge control valve" mentioned above in "SUMMARY OF THE INVENTION", and a portion of the ECU 60 that executes step S182 of FIG. 5 provides the above-mentioned "fuel cut control unit". A portion of the ECU 60 that executes step S176 provides the above-mentioned "opening failure detecting unit", and a portion of the ECU 60 that executes step S180 provides the above-mentioned "fuel cut restricting unit". Also, in the second embodiment, a portion of the ECU 60 that executes step S178 provides the above-mentioned "condition distinguishing unit".

Third Embodiment

Figure 6:
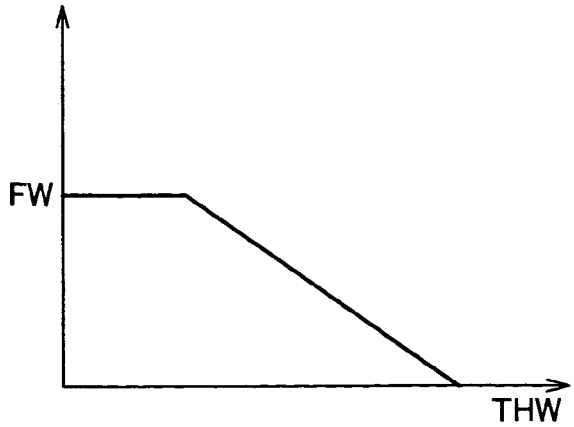
FIG. 6 is a map of a water temperature factor FW used in a third embodiment of the invention.
Figure 7:
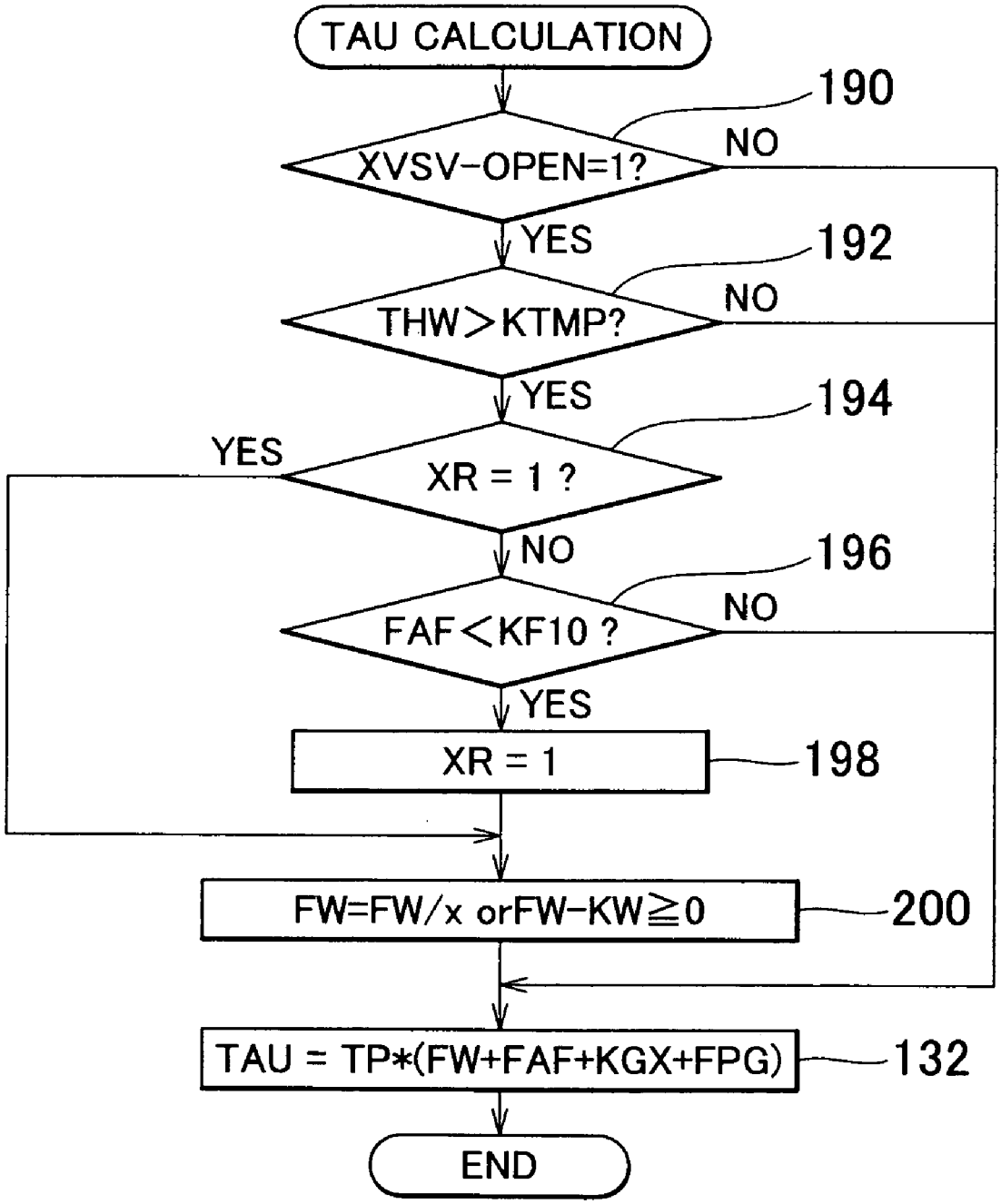
FIG. 7 is a flowchart of a TAU calculation routine executed in the third embodiment of the invention.

Referring next to FIG. 6 and FIG. 7, the third embodiment of the invention will be described. The system of this embodiment is similar in construction to that of the first or second embodiment, and is characterized in that the ECU 60 executes a routine shown in FIG. 7 as described later, in place of the process of step S132 of FIG. 3.

In the present embodiment, too, the ECU 60 calculates the fuel injection time TAU according to the above-indicated expression (2): TAU=TP×(FW+FAF+KGX+FPG). The water temperature factor FW included in this expression is a factor for increasing the amount of fuel upon a cold start of the engine so as to stabilize the operating state of the engine. FIG. 6 is a map showing one example of the relationship between the water temperature factor FW and the coolant temperature THW. As shown in FIG. 6, FW is set as a function of the coolant temperature THW, and is made equal to zero in a range (e.g., a range of THW≧70° C.) in which the engine has been sufficiently warmed up.

When an opening failure occurs in the purge VSV 28, purging of the canister 20 is started at the same time that the engine is started. If a large amount of fuel is collected in the canister 20, purge gas having a high fuel concentration flows into the intake passage 30 immediately after the start of the engine. In this condition, the air-fuel mixture drawn into each cylinder of the engine is sufficiently fuel-rich even if correction for increasing the amount of fuel by using the water temperature factor FW is not performed. Rather, if the fuel amount increasing correction using FW is performed, the air-fuel mixture becomes excessively fuel-rich, resulting in deterioration of emissions or other problems. In view of this situation, the system of the present embodiment restricts the fuel amount increasing correction using the water temperature factor FW when an opening failure of the purge VSV 28 is detected.

FIG. 7 shows a flowchart of a TAU calculation routine executed by the ECU 60 in the present embodiment for accomplishing the above-described function. As a precondition for executing this routine, the ECU 60 is supposed to execute step S130 shown in FIG. 3, namely, execute the process of calculating the purge correction factor FPG. Also, the content of the final step in the routine of FIG. 7 is identical with that of step S132 shown in FIG. 3, and is thus labeled with the same reference numeral "132".

In the routine shown in FIG. 7, it is initially determined in step S190 whether the opening failure determination flag XVSV-OPEN is set at 1. If it is determined that XVSV-OPEN=1 is not satisfied, the ECU 60 judges that no opening failure occurs in the purge VSV 28. In this case, the ECU 60 executes step S132 so as to calculate the fuel injection time TAU by a normal method, and finishes the current control cycle. If it is determined that XVSV-OPEN=1 is satisfied, on the other hand, it is then determined in step S192 whether the coolant temperature THW is higher than a criteria temperature KTMP.

Under an extremely low-temperature environment in which the coolant temperature THW is extremely low, the fuel injection time TAU calculated as described above is so large that it is no use taking account of the influence of purge gas. In this situation, the fuel amount increasing correction using the water temperature factor FW should not be restricted even if an opening failure occurs in the purge VSV 28. The above-indicated temperature KTMP is a criteria value used for determining whether the coolant temperature THW is such an extremely low temperature. If it is determined that THW>KTMP is not satisfied, namely, THW is equal to or lower than KTMP, the ECU 60 judges that the engine is placed in an extremely low-temperature environment, and the correction using FW for increasing the fuel amount should not be restricted. In this case, the ECU 60 immediately executes step S132 so as to calculate the fuel injection time TAU by the normal method.

If step S192 determines that THW>KTMP is satisfied, the ECU 60 judges it as being appropriate to restrict the fuel amount increasing correction using FW as needed. In this case, the ECU 60 determines in step S194 whether a rich flag XR is set at 1. If it is determined that XR=1 is not satisfied, it is then determined in step S196 whether the air/fuel ratio feedback factor FAF is smaller than an excessive rich determination value KF10. If it is determined that FAF<KF10 is satisfied, 1 is set to the rich flag XR in step S198.

As described above, the rich flag XR is set at 1 when the air/fuel ratio feedback factor FAF is smaller than the excessive rich determination value KF10. Here, the excessive rich determination value KF10 is a value that cannot be reached by FAF when the correction using the water temperature factor FW for increasing the fuel amount is normally performed. Thus, the rich flag XR is set at 1 in the case where the correction using FW for increasing the fuel amount is performed under an environment where a large amount of fuel-rich purge gas flows into the engine. In other words, the rich flag XR is set at 1 only in the case where it is desirable to restrict the correction using FW for increasing the fuel amount.

When step S196 determines that FAF<KF10 is not satisfied, namely, FAF is equal to or larger than KF10, the ECU 60 judges it as being unnecessary to restrict the correction using the water temperature factor FW for increasing the fuel amount. In this case, the ECU 60 immediately executes step S132 so as to calculate the fuel injection time TAU by the normal method. In the case where step S198 is executed and the case where step S194 determines that XR=1 is satisfied, on the other hand, the ECU 60 judges that the correction using FW for increasing the fuel amount should be restricted. In this case, the ECU 60 performs the process of reducing the water temperature factor FW while setting the lower limit thereof at zero in step S200. More specifically, the water temperature factor FW that provides a basis for calculation of the fuel injection time TAU is calculated in step S200 by dividing the water temperature factor FW determined in relation to the coolant temperature THW by a predetermined number x (for example, 2), or by subtracting a predetermined value KW from the water temperature factor FW related to THW. After step S200 is executed, the fuel injection time TAU is calculated in step S132 by using FW calculated in step S200.

According to the routine shown in FIG. 7, when an opening failure occurs in the purge VSV 28, the amount of increase of the fuel amount due to the water temperature factor FW can be reduced under a condition that the air/fuel ratio feedback factor FAF has been actually updated to the excessively rich side, as explained above. Thus, the system of the present embodiment is able to avoid wasteful or unnecessary correction for increasing the fuel amount when an opening failure occurs in the purge VSV 28, while assuring good cold-start performance of the engine by continuing the fuel amount increasing correction when the purge gas has a relatively low fuel concentration.

In the present embodiment, when an opening failure occurs in the purge VSV 28, the ECU 60 performs leaning of the vapor concentration learned value FGPG through the process of steps S160–S166 shown in FIG. 4, as in the case of the first embodiment. If the correction using FW for increasing the fuel amount is carried out in the course of learning of FGPG by this method, FGPG may be updated to an inappropriate value due to an influence of the fuel amount increasing correction. However, if the correction using FW for increasing the fuel amount is restricted in the manner as described above, an amount of error reflected by FGPG during the correction can be reduced. In this respect, too, the system of the present embodiment is advantageous in controlling the air/fuel ratio with high accuracy in the event of an opening failure of the purge VSV 28.

In the third embodiment as described above, the purge VSV 28 corresponds to the "purge control valve" mentioned above in "SUMMARY OF INVENTION", a portion of the ECU 60 that executes step S132 of FIG. 3 or FIG. 7 provides the above-mentioned "cold-start correcting unit", a portion of the ECU 60 that executes step S190 of FIG. 7 provides the above-mentioned "opening failure detecting unit", and a portion of the ECU 60 that executes step S200 of FIG. 7 provides the above-mentioned "correction amount reducing unit". Also, in the third embodiment, updating of the air/fuel ratio feedback factor FAF to a value that is smaller than the excessive rich determination value KF10 corresponds to the above-mentioned "excessively fuel-rich condition", and a portion of the ECU 60 that executes step S196 of FIG. 7 provides the above-mentioned "excessive richness determining unit".

Fourth Embodiment

Figure 8:
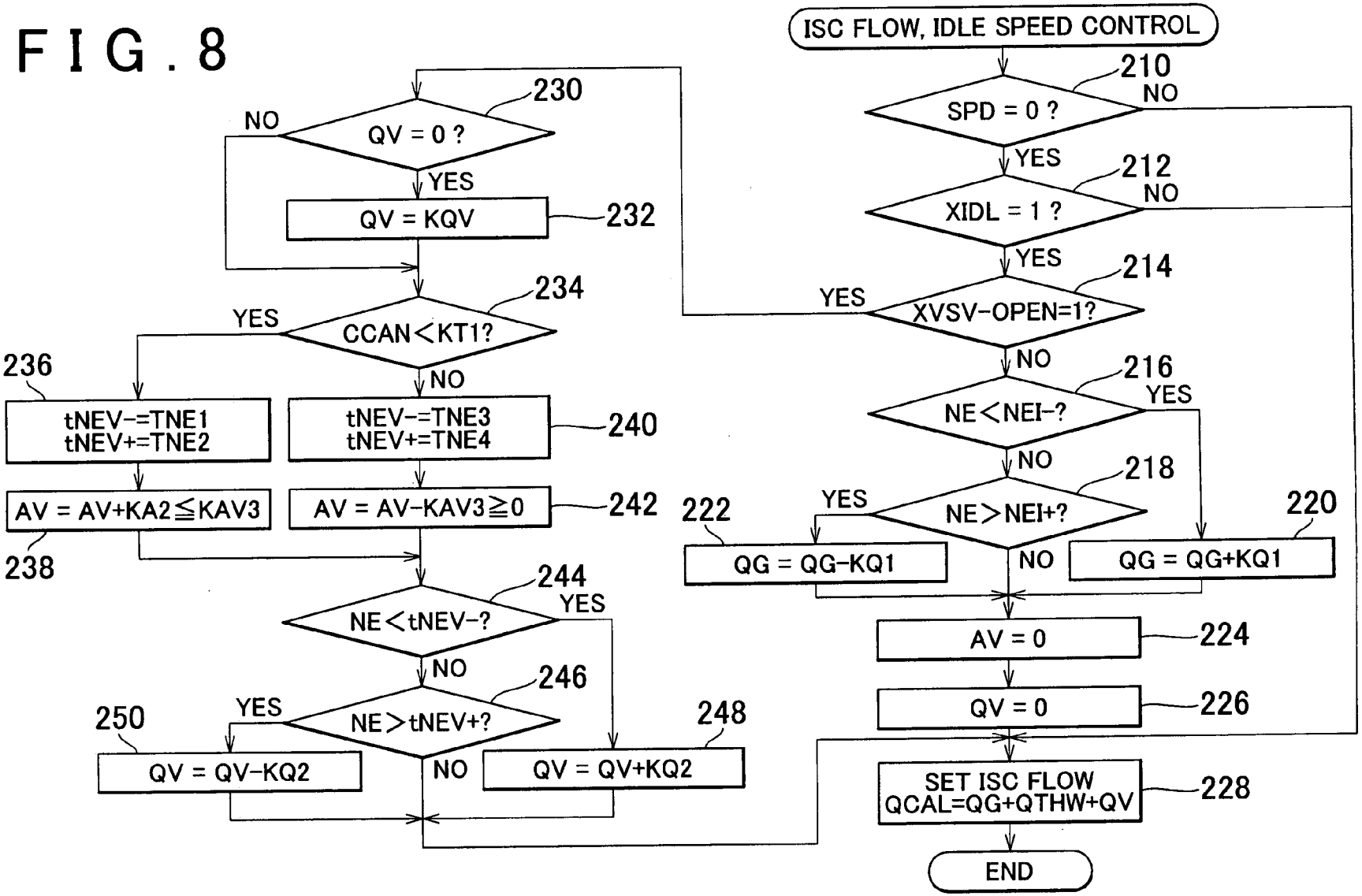
FIG. 8 is a flowchart of an ISC flow control routine executed in a fourth embodiment of the invention.
Figure 9:
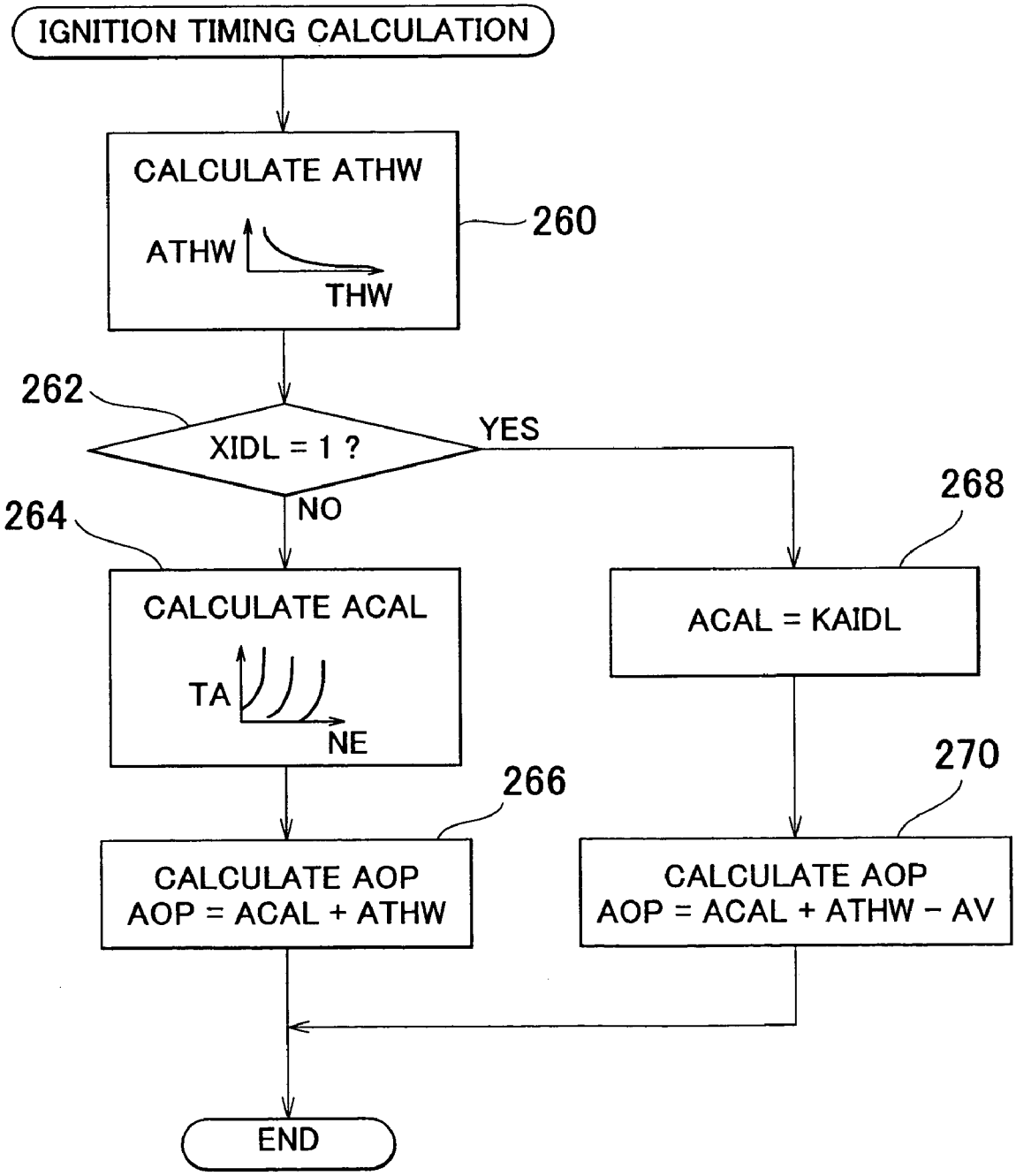
FIG. 9 is a flowchart of an ignition timing calculation routine executed in the fourth embodiment of the invention.

Referring next to FIG. 8 and FIG. 9, the fourth embodiment of the invention will be described. The system of this embodiment is similar in construction to that of the first, second or third embodiment, and is characterized in that the ECU 60 executes routines shown in FIG. 8 and FIG. 9 as described later, in addition to or in place of the routines shown in FIG. 4, FIG. 5 and FIG. 7.

In the system of the present embodiment, when an opening failure occurs in the purge VSV 28, the amount QPG of purge gas flowing into the intake passage 30 during an operation of the engine cannot be controlled. In this situation, an influence of the purge gas on the air/fuel ratio is particularly noticeable when the engine is in an idling state in which the intake air flow (or air mass flow) GA is small and the intake pipe pressure PM is lowered to a large negative pressure (which results in an increase in the amount QPG of the purge gas). In other words, when an opening failure occurs in the purge VSV 28, the operating state of the engine is likely to be unstable particularly during idling because a large amount of uncontrollable purge gas flows in the system.

The influence of the purge gas on the air/fuel ratio is reduced as the intake air flow GA increases. Accordingly, the operating state of the engine during idling is more stabilized as the amount of air drawn into the engine during idling (which amount will be called "ISC flow QCAL") increases. Also, the ISC flow QCAL can be increased by increasing the idle speed (i.e., the engine speed during idling). In view of these facts, when an opening failure occurs in the purge VSV 28, the system of the present embodiment sets the target idle speed at a value higher than the normal target value so as to increase the ISC flow QCAL.

FIG. 8 shows a flowchart of an ISC flow control routine executed by the ECU 60 for accomplishing the above-described function. In this routine, it is initially determined in step S210 whether the vehicle speed SPD is equal to 0, and is then determined in step S212 whether the idle flag XIDL is set at 1. If either of these conditions is not satisfied, the ECU 60 judges that idling of the engine is not requested, and immediately executes step S228 as described later. If both of the conditions of steps S210 and S212 are satisfied, on the other hand, it is determined in step S214 whether the opening failure determination flag XVSV-OPEN is set at 1.

If step S214 determines that the opening failure determination flag XVSV-OPEN=1 is not satisfied, the ECU 60 judges that no opening failure occurs in the purge VSV 28. In this case, the engine speed NE is controlled to a target idle speed NEI by a normal or known method. More specifically, it is determined in step S216 whether the engine speed NE is lower than a target lower limit value NEI−. If it is determined that NE<NEI− is not satisfied, namely, NE is equal to or higher than NEI−, it is then determined in step S218 whether the engine speed NE is higher than a target upper limit value NEI+. If it is determined that NE>NEI+ is not satisfied, namely, NE is equal to or lower than NEI+, the ECU 60 judges that the engine speed NE is within a target range of the idle speed. In this case, the ECU 60 judges the current ISC flow QCAL as being the proper amount, and proceeds to step S224 (which will be described later) without updating an ISC flow learned value QG.

If step S216 determines that NE<NEI− is satisfied, on the other hand, the ECU 60 judges that the current ISC flow QCAL is too small, and the engine speed NE does not reach the target range. In this case, the ECU 60 increases the ISC flow learned value QG by a predetermined value KQ1 in step S220. If step S218 determines that NE>NEI+ is satisfied, the ECU 60 judges that the current ISC flow QCAL is too large, and the engine speed NE exceeds the target range. In this case, the ECU 60 reduces the ISC flow learned value QG by the predetermined value KQ1 in step S222.

Following the above-described series of operations in the routine shown in FIG. 8, the ignition retard amount AV is made equal to 0 in step S224, and the ISC flow increase value QV is made equal to 0 in step S226. Step S226 is followed by step S228 in which the ISC flow QCAL is calculated according to the following expression (3):

$$QCAL=QG+QTWH+QV \quad (3)$$

In the above expression (3), the ISC flow increase value QV is a correction item for increasing the ISC flow QCAL in the event of an opening failure of the purge VSV 28. Since no opening failure occurs in the purge VSV 28 in the above situation, 0 is set to QV. As a result, the ISC flow QCAL is calculated as being equal to (QG+QTHW). QTHW is a water temperature correction value of the ISC flow. The ECU 60 stores a map that defines the water temperature correction value QTHW in relation to the coolant temperature THW, and calculates the ISC flow QCAL by using QTHW read from the map. According to the routine shown in FIG. 8 as explained above, when the purge VSV 28 is normal, the ISC flow QCAL can be controlled by increasing or reducing the ISC flow learned value QG as needed so that the engine speed NE becomes equal to the target idle speed NEI.

In the routine shown in FIG. 8, if it is determined in step S214 that the opening failure determination flag XVSV-OPEN is set at 1, a process of dealing with the opening failure of the purge VSV 28 is carried out. In this process, it is determined in step S230 whether the ISC flow increase value QV is set at 0. If it is determined that QV is equal to 0, an initial value KQV is set to QV in step S232. If it is determined that QV is not equal to 0, the ECU 60 judges that the initial value has been set to the ISC flow increase value QV, and skips step S232.

In the routine shown in FIG. 8, it is then determined in step S234 whether a counter value CCAN of a canister purge counter is smaller than a criteria value KT1. The canister purge counter is adapted to count the total time for which the canister 20 is purged of fuel vapor after the engine is started. Immediately after purging of the canister 20 is started, a large amount of fuel may be adsorbed in the canister 20, and therefore purge gas having a high fuel concentration may flow in the system. After the canister 20 has been purged for a certain length of time, the amount of fuel adsorbed in the canister 20 is reduced, and the fuel concentration of the purge gas is accordingly reduced. The above-indicated criteria value KT1 represents a normal length of time it takes until the fuel concentration of the purge gas starts being significantly reduced. By executing step S234, therefore, it can be substantially determined whether the fuel concentration of the purge gas is maintained at the same level (i.e., is kept at a high level), or starts being reduced to a low level.

If step S234 determines that CCAN<KT1 is satisfied, the ECU 60 judges that there is a possibility of a large amount of high-fuel-concentration purge gas flowing due to the opening failure of the purge VSV 28. In this case, the ECU 60 sets a first set value TNE1 to a temporary target lower limit value tNEV− of the idle speed, and sets a second set value TNE2 to a temporary target upper limit value tNEV+ of the idle speed in step S236. The first set value TNE1 and the second set value TNE2 are larger by a predetermined value than the normal target lower limit value NEI− and the normal target upper limit value NEI+, respectively. Thus, with the process of step S236, the target range of the idle speed NEI in the event of an opening failure of the purge VSV 28 can be shifted to the higher speed range compared to the target range employed when the purge VSV 28 is normal. The target range set in step S236 will be hereinafter called "failure-mode initial target range".

In the routine shown in FIG. 8, step S236 is followed by step S238 in which the ignition retard amount AV is increased by a predetermined value KA2 within a range that does not exceed the upper limit value KAV3. As described above with respect to step S224, the ignition retard amount AV is set at 0 when the purge VSV 28 is normal. With step S238 thus executed, the ignition timing can be shifted to the retard side in the event of an opening failure of the purge VSV 28, relative to the timing employed when the purge VSV 28 is normal. The effect provided by retarding the ignition timing will be explained later with reference to FIG. 9.

In the routine shown in FIG. 8, if step S234 determines that CCAN<KT1 is not satisfied, namely, CCAN is equal to or larger than KT1, the ECU 60 judges that the fuel concentration of the purge gas starts being reduced. In this case, a third set value TNE3 is set to the temporary target lower limit value tNEV− of the idle speed, and a fourth set value TNE4 is set to the temporary target upper limit value tNEV+ of the idle speed in step S240. The third set value TNE3 is higher than the normal target lower limit value NEI− but lower than the first set value TNE1. Similarly, the fourth set value TNE4 is higher than the normal target lower limit value NEI+ but lower than the second set value TNE2. Thus, with the process of step S240, the target range of the idle speed NEI can be set between the normal target range (i.e., the target range employed when the purge VSV 28 is normal) and the failure-mode initial target range set in the above step S236. The target range set in step S240 will be hereinafter called "failure-mode later target range".

In the routine shown in FIG. 8, step S240 is followed by step S242 in which the ignition retard amount AV is reduced by a predetermined value KA3 with the lower limit value of AV being set at 0. With the process of step S242, the ignition retard amount AV that has been gradually increased in step S238 until CCAN reaches KT1 can be gradually reduced after CCAN reaches KT1.

After execution of step S238 or S242, it is determined in step S244 whether the engine speed NE is lower than the temporary target lower limit value tNEV−. If it is determined that NE<tNEV− is not satisfied, namely, NE is equal to or higher than tNEV−, it is then determined in step S246 whether the engine speed NE is higher than the temporary target upper limit value tNEV+. If it is determined that NE>tNEV+ is not satisfied, namely, NE is equal to or lower than tNEV+, the ECU 60 judges that the engine speed NE is within the failure-mode initial target range set in the above step S236 or the failure-mode later target range set in the above step S240 (the failure-mode initial target range and the failure-mode later target range will be generally called "failure-mode target range" when appropriate). In this case, the ECU 60 judges the current ISC flow increase value QV as being the proper amount, and proceeds to step S228 without updating QV.

If step S244 determines that NE<tNEV− is satisfied, the ECU 60 judges that the current ISC flow QCAL is too small, and the engine speed NE is below the failure-mode target range. In this case, the ECU 60 increases the ISC flow increase value QV by a predetermined value KQ2 in step S248. If step S246 determines that NE>tNEV+ is satisfied, the ECU 60 judges that the current ISC flow QCAL is too large, and the engine speed NE exceeds the failure-mode target range. In this case, the ECU 60 reduces the ISC flow increase value QV by a predetermined value KQ2 in step S250.

Subsequently, the ECU 60 calculates the ISC flow QCAL=QG+QTWH+QV in step S228. In this step, a value learned when the purge VSV 28 is normal is assigned to the ISC flow learned value QG, and a value obtained from the map that defines the water temperature correction value QTHW in relation to the coolant temperature THW is assigned to the water temperature correction value QTHW, as in the case where the purge VSV 28 is normal. To the ISC flow increase value QV is assigned a value set in the process of steps S230–S250 as described above.

When an opening failure occurs in the purge VSV 28, the failure-mode target range, which is a higher speed range than the normal target range, is used as a target range of the engine speed, and therefore the ISC flow increase value QV is set at a value that is not equal to zero. Also, the increase value QV set in the initial stage of purging in which the failure-mode initial target range is used is larger than that set in the later purging stage in which the failure-mode later target range is used. Thus, according to the routine shown in FIG. 8, a larger ISC flow QCAL, i.e., a larger amount of intake air during idling, than the normal amount can be generated in the event of an opening failure of the purge VSV 28, and the ISC flow QCAL can be reduced with a reduction in the fuel concentration of the purge gas.

With a large amount of air (represented by the ISC flow QCAL) flowing during idling in the event of an opening failure of the purge VSV 28, otherwise possible fluctuations in the air/fuel ratio due to flow of the purge gas can be suppressed. Also, since the ISC flow QCAL can be reduced as purging of the canister 20 proceeds, the ISC flow ISC is prevented from being unnecessarily large (i.e., an unnecessarily large amount of intake air will not flow during idling,) under a situation where the influence of the purge gas on the air/fuel ratio has been reduced. Thus, the system of the present embodiment is able to efficiently stabilize the operating state of the engine by increasing the ISC flow QCAL within the required, minimum range when an opening failure occurs in the purge VSV 28.

According to the routine shown in FIG. 8, when an opening failure occurs in the purge VSV 28, the ISC flow QCAL can be increased by assigning an appropriate value to the ISC flow increase value QV without updating the ISC flow learned value QG. The ISC flow increase value QV is set at 0 when the purge VSV 28 is normal, as indicated in step S226. Namely, after occurrence of an opening failure in the purge VSV 28, the ISC flow increase value QV naturally becomes equal to 0 once repair of the purge VSV 28 is finished and the opening failure determination flag XVSV-OPEN is reset to 0. Thus, the system of the present embodiment can properly increase the ISC flow QCAL in the event of an opening failure of the purge VSV 28, while surely preventing the influence of the increase of the ISC flow from remaining after repair of the purge VSV 28.

In the routine shown in FIG. 8, the process of changing the ignition retard amount AV is performed based on the condition of the purge VSV 28 and the total time of purging of the canister 20, as described above. Referring next to FIG. 9, the reason why the ignition retard amount AV is changed in this manner and the effect provided by the change will be explained.

FIG. 9 shows a flowchart of an ignition timing calculation routine executed by the ECU 60 in the present embodiment. In the routine as shown in FIG. 9, a water temperature correction value ATHW of the ignition timing is initially calculated in step S260. The ECU 60 stores a map that defines the relationship between the water temperature correction value ATHW and the coolant temperature THW as indicated in the block of step S260 in FIG. 9. In step S260, the ECU 60 acquires the water temperature correction value ATHW corresponding to the coolant temperature THW with reference to the map.

It is then determined in step S262 whether the idle flag XIDL is set at 1. If it is determined that XIDL=1 is not satisfied, namely, XIDL is not equal to 1, the ECU 60 judges that the engine is not in an idling state, and then proceeds with a process of determining the ignition timing in accordance with the operating conditions of the engine. More specifically, the base ignition timing ACAL is calculated in step S264 based on the engine speed NE and the throttle opening TA. The ECU 60 stores a two-axis map that defines the base ignition timing ACAL in relation to NE and TA, as indicated in the block of step S264 in FIG. 9. In step S264, the ECU 60 determines the base ignition timing ACAL corresponding to the current NE and TA with reference to the map. Each of the three curves depicted in the map of step S264 represents an image of an equi-ACAL curve along which ACAL has the same value.

After calculation of the base ignition timing ACAL, the final ignition timing AOP is calculated in step S266 according to the following expression (4).

$$AOP=ACAL+ATHW \quad (4)$$

In this manner, while the engine is not idling, the ECU 60 can calculate the final ignition timing AOP appropriate to the engine speed NE, throttle opening TA and the coolant temperature THW. Thereafter, the ECU 60 executes an ignition process in the engine so as to achieve the final ignition timing AOP thus obtained.

In the routine shown in FIG. 9, when it is determined in step S262 that XIDL=1 is satisfied, the ECU 60 judges that the engine is idling. In this case, a process of determining the optimum ignition timing of the engine when idling is performed. More specifically, step S268 is executed to set a fixed value KAIDL to the base ignition timing ACAL.

Next, the final ignition timing AOP of the idling engine is calculated in step S270 according to the following expression (5).

$$AOP=ACAL+ATHW-AV \quad (5)$$

In the above expression (5), AV is the ignition retard amount set in the routine shown in FIG. 8. According to the routine shown in FIG. 8, 0 is set to AV in step S224 when the purge VSV 28 is normal. When an opening failure occurs in the purge VSV 28, AV is increased in step S238 and then reduced in step S242 as purging of the canister 20 proceeds. In the present embodiment, the ignition timing is defined by the crank angle before the top dead center (i.e., the value of BTDC). Thus, the above-indicated expression (5) indicates that the final ignition timing AOP is shifted to the retard side (i.e., to the side of ATDC) as the ignition retard amount AV increases.

The internal combustion engine of the present embodiment is basically designed such that the output torque produced during idling is reduced as the ignition retard amount AV by which the ignition timing is retarded increases. Therefore, in the initial purge stage in which the ignition retard amount AV is increased in the event of an opening failure of the purge VSV 28, the output torque per unit air amount is gradually reduced. In the system of the present embodiment in which feedback control for controlling the engine speed NE to within the target range is performed, if the output torque is reduced as described above, the ISC flow QCAL is increased so as to compensate for the reduction in the output torque. In the later purge stage in which the ignition retard amount AV is reduced as purging of the canister 20 proceeds, the ISC flow QCAL is reduced so as not to produce excessively large output torque.

Thus, according to the routines shown in FIG. 8 and FIG. 9, when an opening failure occurs in the purge VSV 28, the final ignition timing AOP is changed so that a large amount of intake air (i.e., large ISC flow QCAL) can be generated during idling of the engine while the fuel concentration of the purge gas is high, and so that the ISC flow QCAL can be suitably reduced as the fuel concentration of the purge gas decreases. Accordingly, the system of the present embodiment is able to sufficiently stabilize the operating state of the idling engine even when an opening failure occurs in the purge VSV 28.

Figure 10:
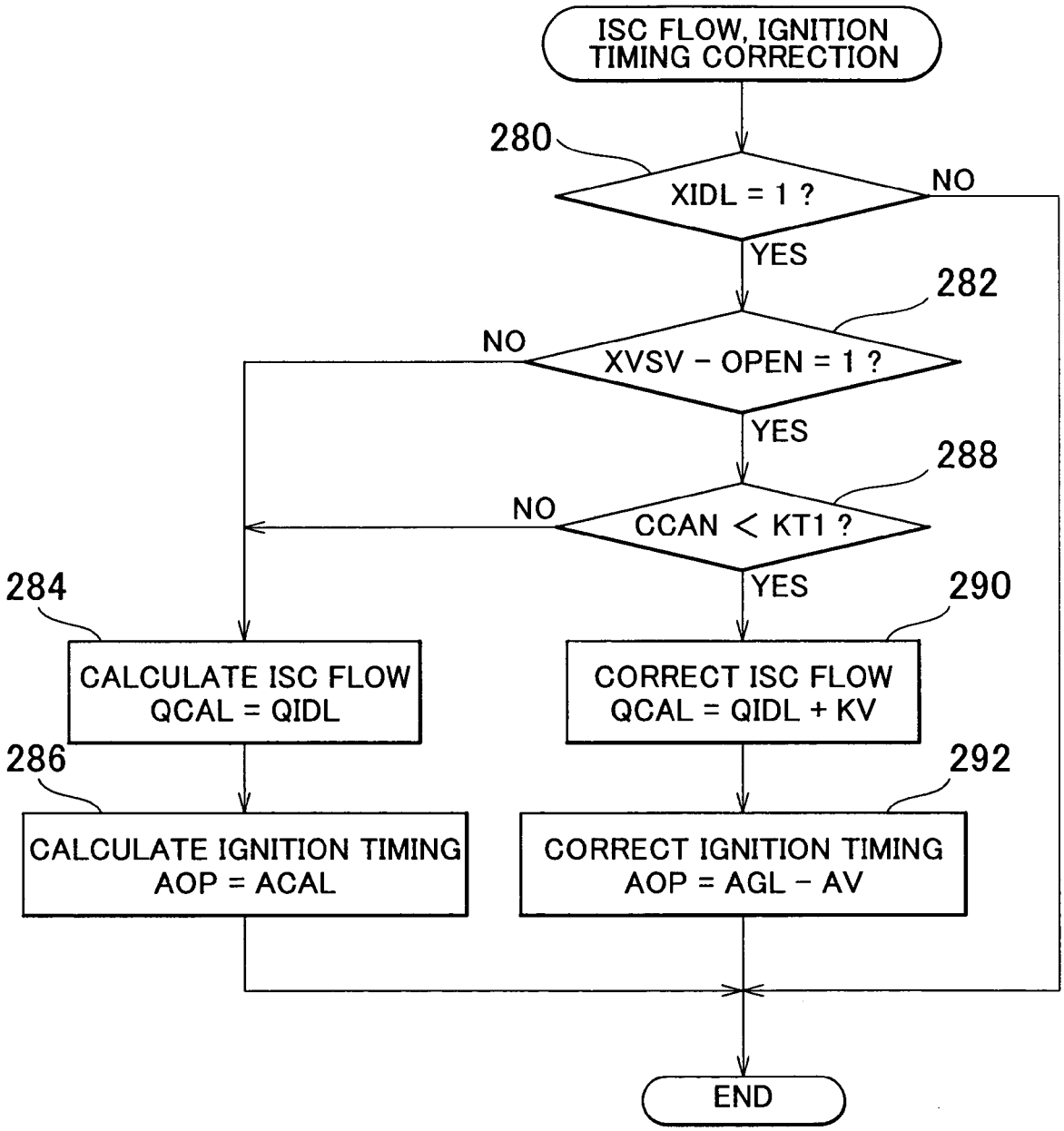
FIG. 10 is a flowchart of an ISC flow control routine executed in a modified example of the fourth embodiment of the invention.

While the engine speed NE is controlled in a feedback fashion during idling in the fourth embodiment as described above, such feedback control is not essential to the invention. FIG. 10 is one example of a flowchart for appropriately changing the ISC flow QCAL without performing feedback control of the engine speed NE.

In the routine shown in FIG. 10, it is determined in step S280 whether XIDL=1 is satisfied. If it is determined that XIDL=1 is not satisfied, the current control cycle is immediately finished. If it is determined that XIDL=1 is satisfied, it is then determined in step S282 whether XVSV-OPEN=1 is satisfied. If it is determined that XVSV-OPEN=1 is not satisfied, namely, XVSV-OPEN is not equal to 1, the ISC flow QCAL is calculated in step S284, and the final ignition timing AOP is calculated in step S286, assuming that the purge VSV 28 is normal.

In the above case, the ISC flow QCAL is set at a fixed value QIDL in step S284. Also, the final ignition timing AOP is set at a fixed value ACAL in step S286. After execution of these steps, the ECU 60 controls the electronic throttle valve 36 so as to achieve the ISC flow QCAL set in step S284, and executes an ignition process so as to achieve the final ignition timing AOP set in step S286.

In the routine shown in FIG. 10, when it is determined in step S282 that XVSV-OPEN=1 is satisfied, it is then determined in step S288 whether the counter value CCAN of the canister purge counter is smaller than the criteria value KT1. If it is determined that CCAN<KT1 is satisfied, there is a possibility that the purge gas has a high fuel concentration. In this case, the ISC flow QCAL is corrected in step S290 and the final ignition timing AOP is corrected in step S292 assuming that the purge gas has a high fuel concentration.

In the above case, the ISC flow QCAL is set at a value (QIDL+KV) obtained by adding an increasing correction value KV to the fixed value QIDL in step S290. In step S292, the final ignition timing AOP is set at a value obtained by subtracting the ignition retard amount AV from the fixed value ACAL. After execution of steps S290 and S292, the ECU 60 controls the electronic throttle valve 36 so as to achieve the ISC flow QCAL set in step S290, and executes the ignition process so as to achieve the final ignition timing AOP set in step S292.

After the canister 20 has been sufficiently purged of fuel vapor under a situation where an opening failure occurs in the purge VSV 28, it is determined in step S288 that CCAN<KT1 is not satisfied, namely, CCAN is equal to or larger than KT1. In this case, the process of steps S284 and S286 is executed in the same manner as in the case where the purge VSV 28 is normal. With these steps executed, the ISC flow can be returned to a normal value after the fuel concentration of the purge gas is reduced, thus avoiding a situation where the ISC flow QCAL is kept being excessively large over an unnecessarily long period of time.

According to the routine of FIG. 10 as explained above, when an opening failure occurs in the purge VSV 28, the ISC flow QCAL can be increased and the final ignition timing AOP can be retarded as long as there is a possibility that purge gas having a high fuel concentration flows in the system. As the ISC flow QCAL increases, the influence of the purge gas on the air/fuel ratio is reduced, and therefore the operating state of the engine is stabilized. In the meantime, as the final ignition timing AOP is retarded, the output torque per unit air amount is reduced, and therefore an otherwise possible increase in the engine speed due to the increase in the ISC flow QCAL can be suppressed. Thus, according to the routine shown in FIG. 10, it is possible to increase the ISC flow QCAL without greatly increasing the idle speed when an opening failure occurs in the purge VSV 28. Namely, the routine shown in FIG. 10, which is simpler than those of FIG. 8 and FIG. 9, makes it possible to provide substantially the same effects as provided in the case where the routines of FIG. 8 and FIG. 9 are executed.

In the fourth embodiment as described above, the purge VSV 28 corresponds to the "purge control valve" as mentioned above in "SUMMARY OF THE INVENTION", and the electronic throttle valve 36 corresponds to the above-mentioned "idle air flow controller". A portion of the ECU 60 that executes step S214 or step S282 provides the above-mentioned "opening failure detecting unit", and a portion of the ECU 60 that executes steps S230-S248 or steps S290 and S292 provides the above-mentioned "idle air amount increasing unit". Also, a portion of the ECU 60 that executes step S234 provides "fuel concentration acquiring unit", a portion of the ECU 60 that executes steps S216–S222 and steps S244–S250 provides the above-mentioned "the idle air flow controller that controls the amount of idle air so that an idle speed becomes substantially equal to a target idle speed", a portion of the ECU 60 that executes steps S236 and S240 provides the above-mentioned "target speed changing unit", and a portion of the ECU 60 that executes steps S238 and S242 provides the above-mentioned "ignition timing retarding unit".

Fifth Embodiment

Referring next o FIG. 11, the fifth embodiment of the invention will be described. The system of this embodiment is similar in construction to that of any of the first through fourth embodiments, and is characterized in that the ECU 60 executes a routine shown in FIG. 11 as described later, in addition to or in place of the routines shown in FIG. 4, FIG. 5 and FIG. 7–FIG. 10.

In the system of the present embodiment, when an opening failure occurs in the purge VSV 28, the canister 20 and the intake passage 30 are constantly held in fluid communication with each other. If the atmospheric vent of the canister 20 is open (i.e., released to the atmosphere) in this condition, a large amount of air may flow through the inside space of the canister 20, and a large amount of purge gas having a high fuel concentration may be generated. If the atmospheric vent of the canister 20 is closed, on the other hand, the flow of the gas through the canister 20 can be shut off, and the amount of purge gas flowing in the system can be reduced, even under a situation where the canister 20 and the intake passage 30 communicate with each other. Accordingly, the system of the present embodiment is arranged such that the CCV 22 is closed so as to close the atmospheric vent of the canister 20 in the event of an opening failure of the purge VSV 28, except when refueling is conducted.

Figure 11:
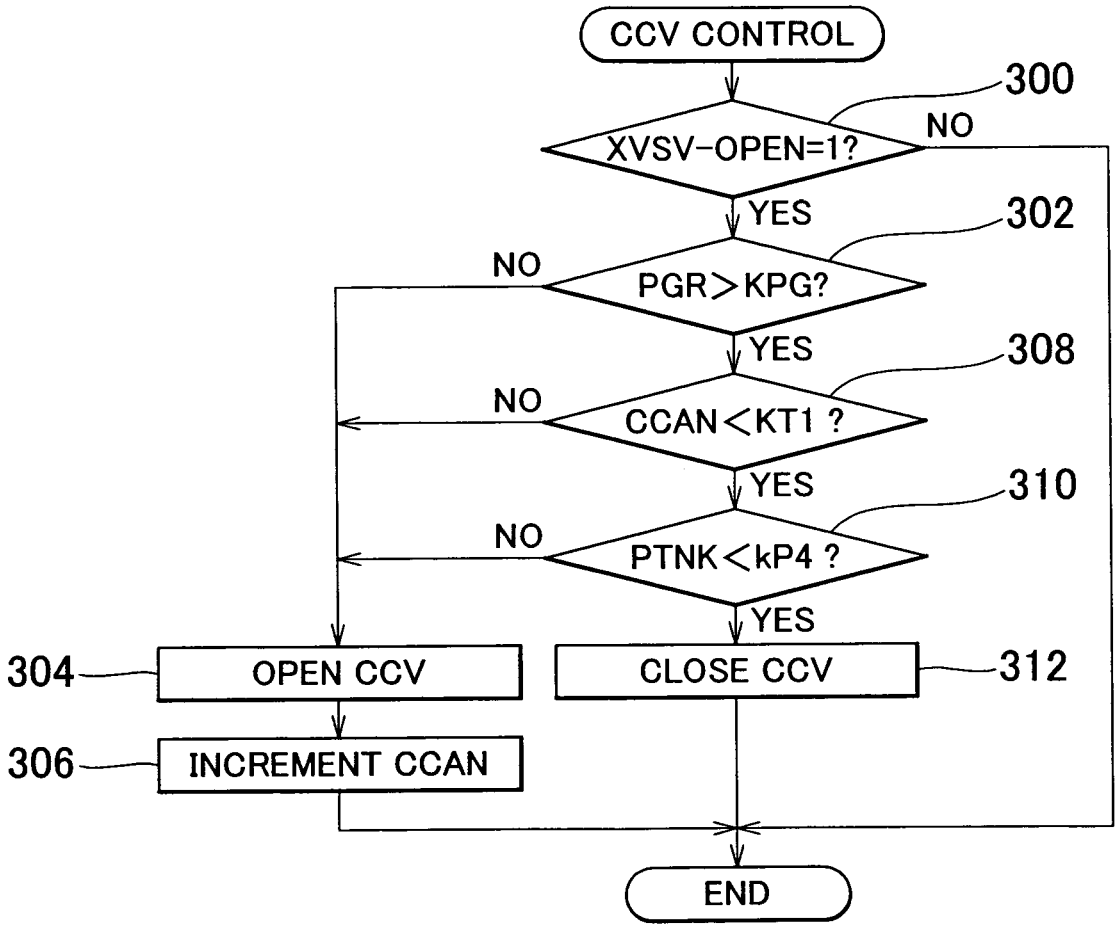
FIG. 11 is a flowchart of a CCV control routine executed in a fifth embodiment of the invention.

FIG. 11 shows a flowchart of a CCV control routine executed by the ECU 60 in the present embodiment for achieving the above-described function. In this routine, it is initially determined in step S300 whether the opening failure determination flag XVSV-OPEN=1 is satisfied. If it is determined that XVSV-OPEN=1 is not satisfied, the current control cycle is immediately finished. If it is determined that XVSV-OPEN=1 is satisfied, on the other hand, the following process is performed so as to deal with the opening failure of the purge VSV 28.

In this case, it is determined in step S302 whether the purge ratio PGR is larger than a predetermined value KPG. The purge ratio PGR is calculated on the assumption that the purge VSV 28 is in the fully open state. Namely, assuming that the purge VSV 28 is fully open, the purge gas flow QPG is estimated based on the intake pipe pressure PM, and the purge ratio PGR=(QPG/GA)×100 is calculated as the ratio of the estimated QPG to the intake air flow (air mass flow) GA.

If the purge ratio PGR is sufficiently small, large fluctuations do not appear in the air/fuel ratio even if an opening failure occurs in the purge VSV 28. In this case, the purge gas flow QPG is not always required to be restricted, but it is rather desirable to permit an adequate amount QPG of purge gas to flow in the system so as to promote purging of the canister 20. KPG used in step S302 is a criteria value for determining whether the current purge ratio PGR is large enough to require restriction of the purge gas flow QPG. If it is determined that PGR>KPG is not satisfied, namely, PGR is equal to or smaller than KPG, the ECU 60 judges that the purge gas QPG need not be restricted at the current point in time. If this determination is made in the routine shown in FIG. 11, the CCV 22 is opened in step S304, and the counter CCAN for counting the canister purge time is incremented in step S306. Then, the current control cycle is finished.

If it is determined in step S302 that PGR>KPG is satisfied, it is then determined in step S308 whether the counter value CCAN of the canister purge counter is smaller than the criteria value KT1. If this condition is not satisfied, the ECU 60 can presume that sufficient purging of the canister 20 has already been carried out, and the fuel concentration of the purge gas is sufficiently reduced. If the fuel concentration of the purge gas is sufficiently reduced, there is no need to restrict the purge gas flow QPG. Rather, it is desirable to open the CCV 22 so as to prevent the pressure in the fuel tank 10 from being lowered to a negative level since such a reduction in the tank pressure may promote generation of fuel vapor in the fuel tank 10. In the routine shown in FIG. 11, therefore, the process of steps S304 and S306 is also executed when CCAN<KT1 is not satisfied.

When it is determined in step S308 that CCAN<KT1 is satisfied, the ECU 60 judges that there is a possibility of flow of purge gas having a high fuel concentration. In this case, it is then determined in step S310 whether the tank pressure PTNK is lower than a criteria value kP4 so as to determine whether refueling is being conducted. The criteria value kP4 represents a pressure level reached by the tank pressure PTNK during refueling. If it is determined that PTNK<kP4 is not satisfied, namely, PTNK is equal to or higher than kP4, there is a possibility that the vehicle is being refueled. If this determination is made in the routine of FIG. 11, the CCV 22 is opened in step S304 to facilitate refueling.

If step S310 determines that PTNK<kP4 is satisfied, the ECU 60 can judge that refueling is not conducted. In this case, the CCV 22 is closed in step S312, and the current control cycle of the routine of FIG. 11 is finished. With the above-described process, when an opening failure occurs in the purge VSV 28, the CCV 22 is closed unless refueling is conducted under a situation where there is a possibility of flow of a large amount of purge gas having a high fuel concentration.

In the system of the present embodiment, if the CCV 22 is closed, air is inhibited from flowing from the atmospheric vent into the canister 20. In this case, the pressure within the canister 20 and the fuel tank 1Q (i.e., tank pressure PTNK) is reduced to a negative level that is limited by the valve opening pressure of the check valve 13 or 24. Namely, the lower limit of the tank pressure PTNK is defined by the pressure at which the check valve 13 or 24 opens. In the system of FIG. 1 in which the check valve 13 is constructed to open before the check valve 24 opens, when the CCV 22 is closed, the tank pressure PTNK is reduced to a negative level that is limited by, in a strict sense, the valve opening pressure of the check valve 13. With this arrangement, the purge gas flowing into the intake passage 30 is limited to fuel vapor generated in the fuel tank 10, or limited to a mixture of the fuel vapor and air flowing into the fuel tank 10 through the check valve 13.

As explained above, the system of the present embodiment can limit the purge gas flow QPG to a sufficiently small amount by closing the CCV 22 when an opening failure occurs in the purge VSV 28. Also, in the system of FIG. 1 in which air is allowed to flow into the fuel tank 10 through the check valve 13, the tank pressure PTNK is prevented from being unduly reduced when the CCV 22 is closed. Since the flow of air into the system is permitted by the check valve 13 provided on the side of the fuel tank 10, fuel flowing into the intake passage 30 can be limited to fuel vapors generated in the fuel tank 10 while the CCV 22 is being closed. Namely, while the CCV 22 is being closed, the system of the present embodiment can inhibit the canister 20 from being purged of fuel vapor, so as not to increase the fuel concentration of the purge gas. Thus, the system of this embodiment is able to sufficiently suppress or reduce fluctuations in the air/fuel ratio due to the opening failure of the purge VSV 28, and effectively prevent the engine from being brought into an unstable operating state even in the event of the opening failure.

In the fifth embodiment as described above, the check valve 13 is arranged to open before the check valve 24 opens so that the canister 20 will not be purged of fuel vapor collected therein when the CCV 22 is in the closed state. However, the invention is not limited to this arrangement. Namely, the functions of reducing the amount QPG of purge gas flowing upon an opening failure of the purge VSV 28 and preventing the tank pressure PTNK from being unduly lowered may also be accomplished by allowing air to flow into the system through the check valve 24. Thus, when the CCV 22 is closed, air may be allowed to flow through the check valve 24 into the system including the canister 20 and the fuel tank 10.

In the fifth embodiment as described above, the purge VSV 28 corresponds to the above-mentioned "purge control valve", and the CCV 22 corresponds to the above-mentioned "canister check valve". A portion of the ECU 60 that executes step S300 provides the above-mentioned "opening failure detecting unit", a portion of the ECU 60 that executes step S312 provides the above-mentioned "atmospheric vent closing unit", and a portion of the ECU 60 that executes step S308 provides the above-mentioned "condition distinguishing unit".

Sixth Embodiment

Figure 12:
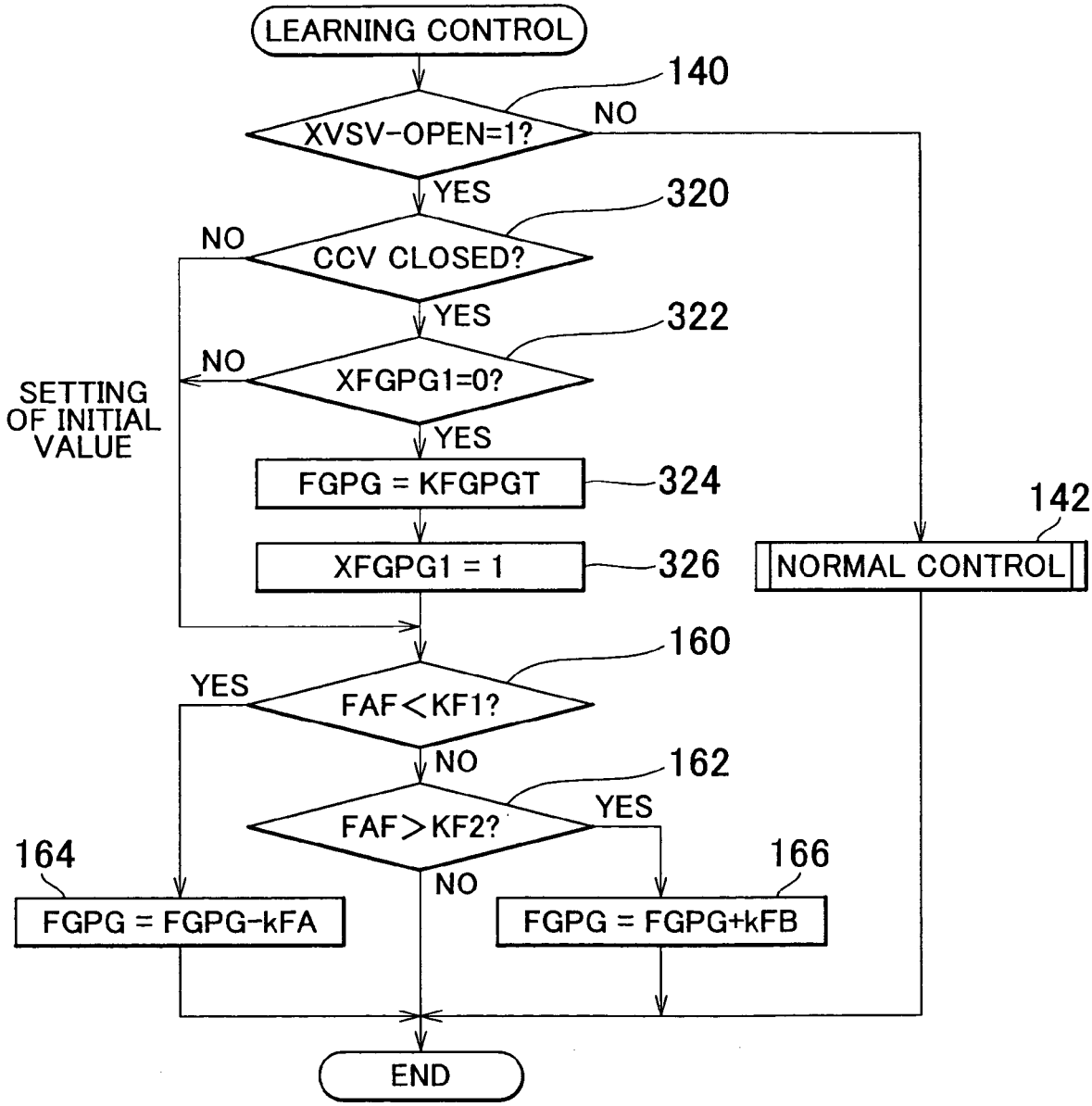
FIG. 12 is a flowchart of a learning control routine executed in a sixth embodiment of the invention.

Referring next to FIG. 12, the sixth embodiment of the invention will be described. The system of the sixth embodiment is similar in construction to that of the fifth embodiment, and is characterized in that the ECU 60 executes a routine shown in FIG. 12 as described later. Like the routine shown in FIG. 4, the routine shown in FIG. 12 is a learning control routine for effecting learning of the vapor concentration learned value FGPG. In the fifth embodiment as described above, whether or not the ECU 60 executes the routine shown in FIG. 4 is optional. In the present embodiment, however, the ECU 60 does not execute the routine of FIG. 4 but executes the routine shown in FIG. 12 instead. In the present embodiment, the ECU 60 calculates the purge correction factor FPG and the fuel injection time TAU by the method as shown in FIG. 3, in the same manner as in the system of the first embodiment.

Like the fifth embodiment as described above, the system of the present embodiment has the function of closing the CCV 22 as needed when an opening failure occurs in the purge VSV 28. When the CCV 22 is closed in this system, air is inhibited from flowing into the canister 20, and therefore purge gas drawn into the intake passage 30 consists solely of fuel vapor generated in the fuel tank 10, or a mixture of the fuel vapor and air that flows through the check valve 13. While the system of the fifth embodiment may be constructed such that air can flow into the system through the check valve 24, the system of the present embodiment is constructed such that only the check valve 13 permits ambient air to flow into the system. Namely, in the present embodiment, the check valve 13 is the only mechanism for allowing flow of air into the system.

The fuel concentration of purge gas that has passed the canister 20 depends upon the condition of adsorption of fuel in the canister 20. Thus, the fuel concentration of the purge gas cannot be treated as a fixed value. However, if the purge gas consists solely of the fuel vapor generated in the fuel tank 10 and air introduced through the check valve 13, the fuel concentration of the purge gas may be treated as fixed to some extent.

In the first embodiment as described above, purge gas caused by an opening failure of the purge VSV 28 may be fuel-lean or fuel-rich, and therefore the ECU 60 monitors the tendency of the air/fuel ratio feedback factor FAF after detection of the opening failure of the purge VSV 28, and sets the rich-side initial value KFGPGR or the lean-side initial value KFGPGL to the vapor concentration learned value FGPG depending upon the tendency of FAF, as indicated in steps S148–S154 of FIG. 4. In the system of the present embodiment, on the other hand, if the CCV 22 is closed, the ECU 60 can treat the air/fuel ratio of the purge gas as a fixed value without observing the tendency of FAF. Thus, in the present embodiment, when the CCV 22 is closed upon detection of an opening failure of the purge VSV 28, the initial value is immediately set to the vapor concentration learned value FGPG.

FIG. 12 shows a flowchart of a learning control routine executed by the ECU 60 for achieving the above-described function. In FIG. 12, the same reference numerals as used in FIG. 4 are used for identifying the corresponding steps, of which detailed description will not be provided. In this routine, when it is determined in step S140 that XVSV-OPEN=1 is satisfied, it is then determined in step S320 whether the CCV 22 is closed.

Even when the purge VSV 28 suffers an opening failure, the CCV 22 is placed in the open state if the purge ratio PGR is small, or the canister 20 has been sufficiently purged of fuel vapor, or there is a high possibility that the vehicle is being refueled, as is understood from FIG. 11. Under these situations, the ECU 60 judges that the initial value should not be set to the vapor concentration learned value FGPG, and executes step S160 and subsequent steps. If step S320 determines that the CCV 22 is in the closed state, it is then determined in step S322 whether the initial value setting flag XFGPG1 is equal to 0.

If it is determined that XFGPG1=0 is not satisfied, namely, XFGPG is equal to 1, the ECU 60 judges that the initial value has been set to the vapor concentration learned value FGPG. In this case, the process of setting the initial value is skipped, and step S160 and subsequent steps are executed. If it is determined in step S322 that XFGPG1=0 is satisfied, step S324 is executed to immediately set the initial value KFGPGT to the vapor concentration learned value FGPG without monitoring the tendency (or direction of shifting) of the air/fuel ratio feedback factor FAF. Step S324 is followed by step S326 in which the initial value setting flag XFGPG1 is set at 1 to indicate that setting of the initial value is finished. After execution of steps S324 and S326, step S160 and subsequent steps are executed so as to effect learning of the vapor concentration learned value FGPG.

As explained above, the initial value KFGPGT set in the above step S324 is determined on the assumption that the purge gas consists solely of the fuel vapor generated in the fuel tank 10 and air drawn from the outside of the fuel tank 10 through the check valve 13. According to the routine shown in FIG. 12, after an opening failure of the purge VSV 28 is detected, the initial value KFGPGT can be immediately set to the vapor concentration learned value FGPG under a condition that the CCV 22 is closed. Thus, the system of the present embodiment is able to make the vapor concentration learned value FGPG close to or equal to a value that matches the actual purge gas concentration within a further reduced period of time after detection of an opening failure of the purge VSV 28, as compared with the system of the first embodiment.

In the sixth embodiment as described above, the vapor concentration learned value FGPG corresponds to the above-mentioned "correction factor", a portion of the ECU 60 that updates the air/fuel ratio feedback factor FAF under a situation where purge gas flows in the system provides the above-mentioned "air/fuel ratio deviation detecting unit", and a portion of the ECU 60 that calculates the fuel injection time TAU by the method shown in FIG. 3 provides the above-mentioned "fuel injection amount calculating unit". Also, a portion of the ECU 60 that executes steps S160–S166 shown in FIG. 12 and executes a process similar to the process of steps S160–S166 in a normal learning process provides the above-mentioned "correction factor updating unit", and a portion of the ECU 60 that executes step S324 of FIG. 12 provides the above-mentioned "initial value setting unit".

Seventh Embodiment

Figure 13:
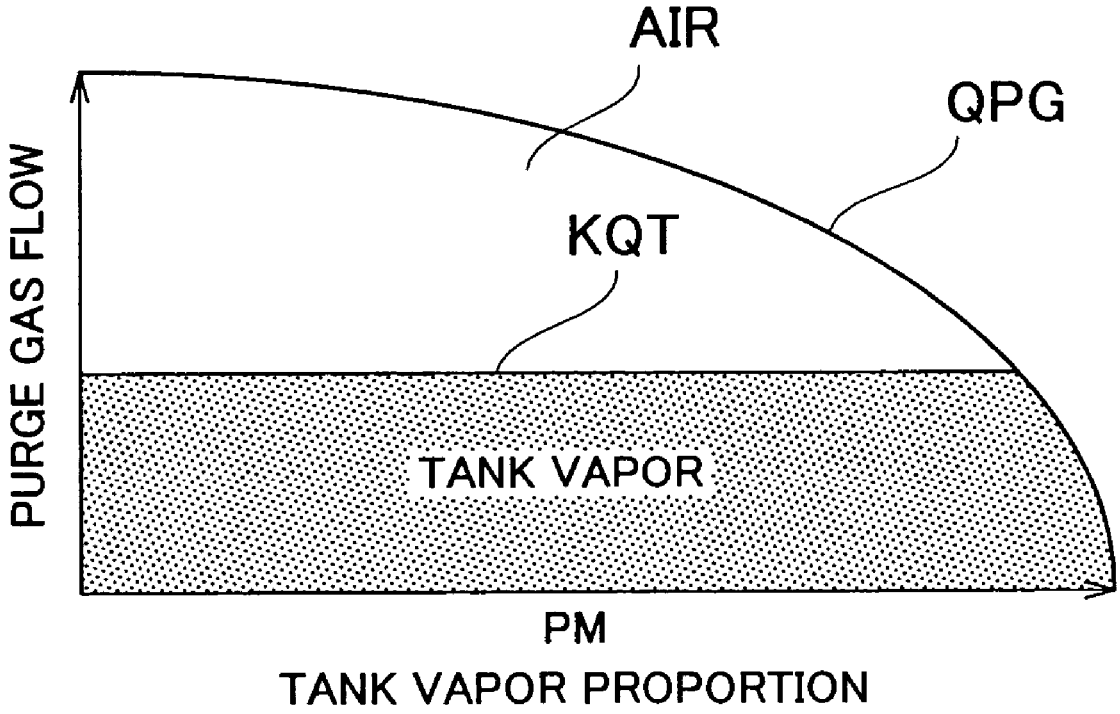
FIG. 13 is a view showing the relationship between the amount QPG of purge gas flowing when a CCV is closed and the intake pipe pressure PM, and the relationship between the purge gas flow QPG and the composition of the purge gas in a seventh embodiment of the invention.
Figure 14:
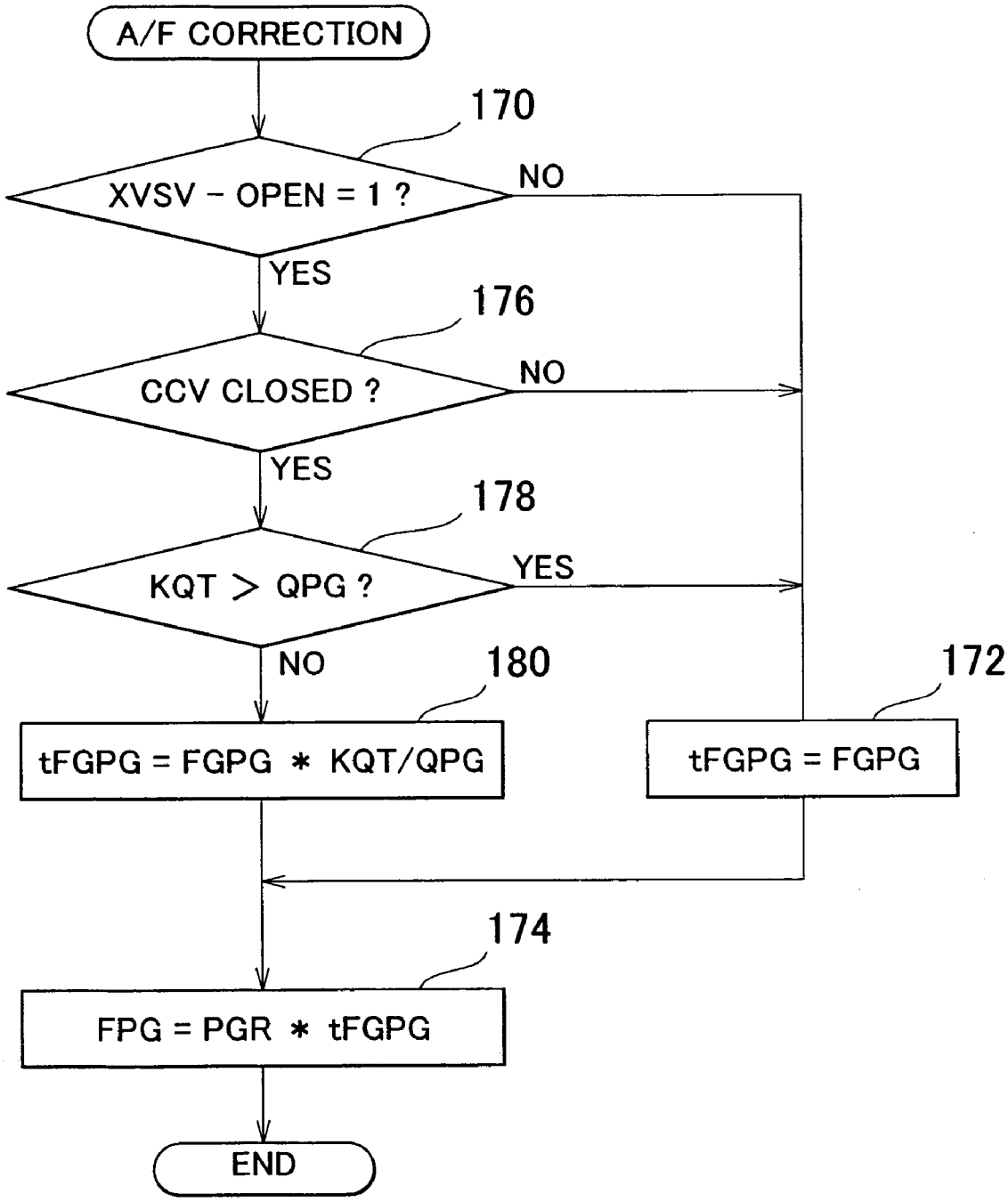
FIG. 14 is a flowchart of an A/F (air/fuel ratio) correction control routine executed in the seventh embodiment of the invention.

Referring next to FIG. 13 and FIG. 14, the seventh embodiment of the invention will be described. The system of the present embodiment is similar in construction to that of the sixth embodiment, and is characterized in that the ECU 60 executes a routine shown in FIG. 14 as described later. Like the system of the sixth embodiment, the system of the present embodiment has the function of closing the CCV 22 as needed when an opening failure occurs in the purge VSV 28. When the CCV 22 is closed in this system, air is inhibited from flowing into the canister 20, and therefore purge gas drawn into the intake passage 30 consists solely of fuel vapor generated in the fuel tank 10, or a mixture of the fuel vapor and air that flows into the fuel tank 10 through the check valve 13.

FIG. 13 shows the relationship between the purge gas flow QPG (vertical axis), which is the amount of purge gas flowing when the CCV 22 is in the closed state, and the intake pipe pressure PM, and also shows the relationship between the purge gas flow QPG and the composition of the purge gas. As shown in FIG. 13, the purge gas flow QPG is a function of the intake pipe pressure PM, and is reduced as the intake pipe pressure PM increases (i.e., approaches the atmospheric pressure). The straight line labeled with KQT in FIG. 13 represents the amount of fuel vapor (which will be called "tank vapor") generated in the fuel tank 10. As shown in FIG. 13, the amount KQT of the tank vapor generated is almost constant irrespective of the intake pipe pressure PM. Thus, when the amount QPG of flow of the purge gas is smaller than the amount KQT of the tank vapor, almost 100% of the purge gas is the tank vapor. If QPG exceeds KQT, air is mixed with the tank vapor in an amount corresponding to the difference (QPG−KQT).

Under a situation where purge gas flows in the system, the ECU 60 corrects the fuel injection time TAU by using the purge correction factor FPG (as shown in FIG. 3). To determine the purge correction factor FPG (=PGR×tFGPG), the vapor concentration learned value FGPG is learned. When the purge gas flows from the canister 20, the fuel concentration of the purge gas may vary depending upon the condition of the canister 20, but does not largely vary depending upon the purge gas flow QPG, i.e., the amount of purge gas passing the purge VSV 28. In this condition, therefore, the ECU 60 can proceed with learning of the vapor concentration learned value FGPG without taking account of the purge gas flow QPG, and FGPG learned by this method does not suddenly deviate from the actual purge gas concentration.

While the CCV 22 is in the closed state, on the other hand, the fuel concentration of the purge gas may be greatly changed with an increase or reduction in the purge gas flow QPG. Namely, if QPG is smaller than the amount KQT of the tank vapor generated, the fuel concentration of the purge gas is always equal to the fuel concentration (represented by $\alpha$) of the tank vapor. If QPG exceeds KQT, on the other hand, the fuel concentration of the purge gas is equal to a value represented by $\alpha \times KQT/QPG$, namely, a function value of QPG. In other words, the fuel concentration of the purge gas varies as a function of QPG.

In the situation where the fuel concentration of the purge gas varies as a function of QPG, it is impossible to learn the vapor concentration learned value FGPG with responsiveness high enough to follow the variations in the fuel concentration. Thus, when the CCV 22 is closed, the system cannot accurately remove the influence of the purge gas by calculating the purge correction factor FPG by the known or normal method. In view of this problem, when purging is conducted with the CCV 22 being closed, the system of the present embodiment changes or switches the method of calculating the purge correction factor FPG depending upon whether QPG exceeds the amount KQT of the tank vapor generated. More specifically, when QPG is smaller than KQT, FPG is calculated by the normal method on the assumption that the fuel concentration of the purge gas is not suddenly changed. When QPG exceeds KQT, on the other hand, tFGPG is obtained by multiplying FGPG by the proportion KQT/QPG of fuel in the purge gas (i.e., tFGPG=FGPG×KQT/QPG), and the purge correction factor FPG is calculated by using tFGPG thus obtained.

FIG. 14 shows a flowchart of an A/F correction control routine executed by the ECU 60 in the present embodiment for achieving the above-described function. In the routine shown in FIG. 14, it is determined in step S170 whether XVSV-OPEN=1 is satisfied. If it is determined that XVSV-OPEN=1 is not satisfied, namely, XVSV-OPEN is not equal to 1, the ECU 60 judges that no process is needed for dealing with an opening failure of the purge VSV 28. In this case, the vapor concentration learned value FGPG learned in another routine (as shown in, for example, FIG. 12) is assigned as it is to the RAM value tFGPG that provides a basis of the purge correction factor FPG in step S172, and the purge correction factor FPG (=PGR×tFGPG) is calculated by using the RAM value tFGPG in step S174.

If step S170 determines that XVSV-OPEN=1 is satisfied, it is then determined in step S176 whether the CCV 22 is closed. If step S176 determines that the CCV 22 is not closed, the ECU 60 judges that the purge gas is not inhibited from flowing from the canister 20, and the fuel concentration of the purge gas does not rapidly change depending upon the purge gas flow QPG. In this case, FPG can be calculated by the normal method, and steps S172 and S174 are subsequently executed.

If step S176 determines that the CCV 22 is in the closed state, the ECU 60 judges that the fuel concentration of the purge gas may rapidly change in accordance with the purge gas flow QPG. In this case, according to the routine shown in FIG. 14, it is determined in step S178 whether the purge gas flow QPG (i.e., the amount of flow of the purge gas) is smaller than the amount KQT of the tank vapor generated. If it is determined that KQT<QPG is satisfied, the ECU 60 judges that almost 100% of the purge gas consists of the tank vapor, and the fuel concentration of the purge gas does not largely vary depending upon QPG. In this case, the ECU 60 judges that calculation of FPG by the normal method is sufficient, and steps S172 and S174 are subsequently executed.

If step S178 determines that KQT>QPG is not satisfied, namely, KQT is equal to or smaller than QPG, the ECU 60 judges that the fuel concentration of the purge gas is a function value of QPG, namely, the fuel concentration varies as a function of QPG. In this case, tFGPG is calculated according to the expression: tFGPG=FGPG×KQT/QPG in step S180 so as to provide a RAM value tFGPG that matches the actual purge gas concentration. Then, the purge correction factor FPG is calculated in step S174 based on the RAM value tFGPG thus obtained. In the case where FPG is calculated in this manner, too, FGPG is ultimately updated so as to match the fuel concentration of the purge gas that consists solely of tank vapor, as in the case where KQT>QPG is satisfied. This is because an excess or shortage of FPG is fed back to FAF, and the tendency of FAF is reflected by FGPG.

As explained above, according to the routine shown in FIG. 12, FPG is calculated by the normal method under a situation where the fuel concentration of the purge gas is not influenced by the purge gas flow QPG. Where the fuel concentration of the purge gas varies as a function of QPG, on the other hand, an appropriate purge correction factor FPG can be calculated by changing only the RAM value tFGPG in accordance with changes in QPG without requiring rapid changes in the vapor concentration learned value FGPG. Thus, even when closing of the CCV 22 gives rise to a situation in which the fuel concentration of the purge gas changes frequently, the system of the present embodiment is able to continue highly accurate air/fuel ratio control without being influenced by the changes in the fuel concentration.

In the seventh embodiment as described above, a portion of the ECU 60 that calculates the fuel injection time TAU by the method shown in FIG. 3 provides the above-mentioned "fuel injection amount calculating unit", a portion of the ECU 60 that executes step S130 of FIG. 3 provides the above-mentioned "correction factor calculating unit", a portion of the ECU 60 that calculates QPG to be used in step S178 of FIG. 14 provides the above-mentioned "purge gas flow detecting unit", a portion of the ECU 60 that executes step S178 provides the above-mentioned "gas flow determining unit", a portion of the ECU 60 that executes step S172 of FIG. 14 provides the above-mentioned "first concentration setting unit", and a portion of the ECU 60 that executes step S180 of FIG. 14 provides the above-mentioned "second concentration setting unit".

While some embodiments of the invention have been described above, for the illustrative purpose only, it is to be understood that the invention is not limited to the details of the illustrated embodiments, but may be embodied with various changes, modifications or improvements, which may occur to those skilled in the art without departing from the spirit and scope of the invention.

What is claimed is:

1. An evaporative emission control system including a canister for collecting fuel vapor flowing from a fuel tank, comprising:

a purge control valve that controls a degree of fluid communication between the canister and an intake passage of an internal combustion engine;

an air/fuel ratio deviation detecting unit that detects a deviation of an air/fuel ratio from a predetermined range under a situation where purge gas is supplied to the intake passage;

a fuel injection amount calculating unit that calculates a fuel injection amount according to an expression including a correction factor for canceling an influence of the purge gas;

a correction factor updating unit that updates the correction factor so as to reduce the deviation of the air/fuel ratio;

an opening failure detecting unit that detects an opening failure of the purge control valve, the opening failure occurring when the purge control valve is stuck in an open state;

a deviating condition determining unit that determines the presence and direction of the deviation of the air/fuel ratio when the opening failure is detected; and an initial value setting unit that assigns a rich-side initial value or a lean-side initial value to the correction factor depending upon the direction of the deviation of the air/fuel ratio when the deviating condition determining unit determines the presence of the deviation of the air/fuel ratio, wherein a difference between a reference value of the correction factor and the rich-side initial value and a difference between the reference value and the lean-side initial value are both larger than an update amount of the correction factor by which the correction factor is updated at a time by the correction factor updating unit.

2. The evaporative emission control system according to claim 1, wherein:

the correction factor updating unit determines the presence of the deviation of the air/fuel ratio if the deviation satisfies a first condition, and updates the correction factor so as to reduce the deviation of the air/fuel ratio;

the deviating condition determining unit determines the presence of the deviation of the air/fuel ratio if the deviation satisfies a second condition; and the deviation that satisfies the second condition is detected with a higher sensitivity than the deviation that satisfies the first condition.

3. The evaporative emission control system according to claim 1, wherein the opening failure detecting unit detects the opening failure of the purge control valve immediately after the engine is started.

4. An evaporative emission control system including a canister for collecting fuel vapor flowing from a fuel tank, comprising:

a purge control valve that controls a degree of fluid communication between the canister and an intake passage of an internal combustion engine;

a fuel cut control unit that executes fuel cut control for stopping fuel injection into the engine when predetermined fuel cut conditions are satisfied;

an opening failure detecting unit that detects an opening failure of the purge control valve, the opening failure occurring when the purge control valve is stuck in an open state; and a fuel cut restricting unit that restricts execution of the fuel cut control when the opening failure is detected.

5. The evaporative emission control system according to claim 4, further comprising a condition distinguishing unit that distinguishes between a first condition in which a fuel concentration of purge gas is higher than a criteria value and a second condition in which the fuel concentration is lower than the criteria value, wherein the fuel cut restricting unit restricts execution of the fuel cut control only under the first condition in which the fuel concentration of purge gas flowing due to the opening failure of the purge control valve is higher than the criteria value.

6. The evaporative emission control system according to claim 5, wherein:

the predetermined fuel cut conditions include a condition that an engine speed is higher than a predetermined fuel cut speed; and the fuel cut restricting unit changes the predetermined fuel cut speed from a normal value employed when the purge control valve is normal, to a higher value than the normal value, when the opening failure of the purge control valve is detected.

7. The evaporative emission control system according to claim 5, wherein the fuel cut restricting unit restricts execution of the fuel cut control by inhibiting the fuel cut control.

8. The evaporative emission control system according to claim 4, wherein:

the predetermined fuel cut conditions include a condition that an engine speed is higher than a predetermined fuel cut speed; and the fuel cut restricting unit changes the predetermined fuel cut speed from a normal value employed when the purge control valve is normal, to a higher value than the normal value when the opening failure of the purge control valve is detected.

9. The evaporative emission control system according to claim 4, wherein the fuel cut restricting unit restricts execution of the fuel cut control by inhibiting the fuel cut control.

10. An evaporative emission control system including a canister for collecting fuel vapor flowing from a fuel tank, comprising:

a purge control valve that controls a degree of fluid communication between the canister and an intake passage of an internal combustion engine;

a cold-start correcting unit that performs correction for increasing a fuel injection amount during a cold start of the engine;

an opening failure detecting unit that detects an opening failure of the purge control valve, the opening failure occurring when the purge control valve is stuck in an open state; and a correction amount reducing unit that reduces an amount by which the fuel injection amount is increased by the cold-start correcting unit when the opening failure is detected.

11. The evaporative emission control system according to claim 10, further comprising an excessive richness determining unit that determines whether an air/fuel ratio indicates an excessively fuel-rich condition, wherein the correction amount reducing unit reduces the amount by which the fuel injection amount is increased by the cold-start correcting unit only when the opening failure of the purge control valve is detected and it is determined that the air/fuel ratio indicates the excessively fuel-rich condition.

12. The evaporative emission control system according to claim 10, wherein the opening failure detecting unit detects the opening failure of the purge control valve immediately after the engine is started.

13. An evaporative emission control system including a canister for collecting fuel vapor flowing from a fuel tank, comprising:

a purge control valve that controls a degree of fluid communication between the canister and an intake passage of an internal combustion engine;

an idle air flow controller that allows a desired amount of idle air to flow during idling of the engine;

an opening failure detecting unit that detects an opening failure of the purge control valve, the opening failure occurring when the purge control valve is stuck in an open state; and an idle air amount increasing unit that increases the amount of idle air when the opening failure is detected.

14. The evaporative emission control system according to claim 13, further comprising a fuel concentration acquiring unit that detects or estimates a fuel concentration of purge gas, wherein the idle air amount increasing unit increases the amount of idle air by an amount that increases as the fuel concentration of the purge gas is higher.

15. The evaporative emission control system according to claim 14, wherein:

the idle air flow controller controls the amount of idle air so that an idle speed becomes substantially equal to a target idle speed; and the idle air amount increasing unit comprises an ignition timing retarding unit that retards an ignition timing of the engine relative to a normal ignition timing when the opening failure is detected.

16. The evaporative emission control system according to claim 14, wherein:

the idle air flow controller controls the amount of idle air so that an idle speed becomes substantially equal to a target idle speed; and the idle air amount increasing unit comprises a target speed changing unit that changes the target idle speed to a speed higher than a normal target speed when the opening failure is detected.

17. The evaporative emission control system according to claim 16, wherein the idle air amount increasing unit further comprises an ignition timing retarding unit that retards an ignition timing of the engine relative to a normal ignition timing when the opening failure is detected.

18. The evaporative emission control system according to claim 13, wherein:

the idle air flow controller controls the amount of idle air so that an idle speed becomes substantially equal to a target idle speed; and the idle air amount increasing unit comprises a target speed changing unit that changes the target idle speed to a speed higher than a normal target speed when the opening failure is detected.

19. The evaporative emission control system according to claim 18, wherein the idle air amount increasing unit further comprises an ignition timing retarding unit that retards an ignition timing of the engine relative to a normal ignition timing when the opening failure is detected.

20. The evaporative emission control system according to claim 13, wherein:

the idle air flow controller controls the amount of idle air so that an idle speed becomes substantially equal to a target idle speed; and the idle air amount increasing unit comprises an ignition timing retarding unit that retards an ignition timing of the engine relative to a normal ignition timing when the opening failure is detected.

21. An evaporative emission control system including a canister for collecting fuel vapor flowing from a fuel tank, wherein the canister has a vapor port that communicates with the fuel tank, a purge port that communicates with an intake passage of an internal combustion engine, and an atmospheric vent located opposite to the vapor port and the purge port with an inside space of the canister interposed therebetween, comprising:

a purge control valve that controls a degree of fluid communication between the purge port and the intake passage;

a canister check valve that opens and closes the atmospheric vent;

an opening failure detecting unit that detects an opening failure of the purge control valve, the opening failure occurring when the purge control valve is stuck in an open state; and an atmospheric vent closing unit that places the canister check valve in a closed state so as to close the atmospheric vent when the opening failure is detected.

22. The evaporative emission control system according to claim 21, further comprising a condition distinguishing unit that distinguishes between a first condition in which purge gas flowing in the system has a high fuel concentration and a second condition in which purge gas flowing in the system has a low fuel concentration, wherein the atmospheric vent closing unit places the canister check valve in the closed state under the first condition in which purge gas flowing due to the opening failure of the purge control valve has a high fuel concentration.

23. The evaporative emission control system according to claim 22, further comprising a check valve that opens so as to permit air to flow into a system including the fuel tank and the canister when a pressure in the system reaches a predetermined negative level.

24. The evaporative emission control system according to claim 23, wherein the check valve is provided at the fuel tank.

25. The evaporative emission control system according to claim 21, further comprising a check valve that opens so as to permit air to flow into a system including the fuel tank and the canister when a pressure in the system reaches a predetermined negative level.

26. The evaporative emission control system according to claim 25, wherein the check valve is provided at the fuel tank.

27. The evaporative emission control system according to claim 26, further comprising:

a fuel injection amount calculating unit that calculates a fuel injection amount according to an expression including a correction factor for canceling an influence of the purge gas;

a correction factor calculating unit that calculates the correction factor based on a fuel concentration of the purge gas;

a purge gas flow detecting unit that detects an amount of flow of the purge gas;

a gas flow determining unit that determines whether the amount of flow of the purge gas is smaller than an amount of tank vapor generated in the fuel tank when the opening failure is detected;

a first concentration setting unit that sets a fuel concentration equivalent to that of the tank vapor to the fuel concentration of the purge gas when the gas flow determining unit determines that the amount of flow of the purge gas is smaller than the amount of the tank vapor under a condition where the opening failure is detected; and a second concentration setting unit that calculates a reduced fuel concentration based on the fuel concentration equivalent to that of the tank vapor, the amount of the tank vapor and the amount of flow of the purge gas, and sets the reduced fuel concentration to the fuel concentration of the purge gas, when the gas flow determining unit determines that the amount of flow of the purge gas is equal to or larger than the amount of the tank vapor under the condition where the opening failure is detected.

28. The evaporative emission control system according to claim 26, further comprising:

an air/fuel ratio deviation detecting unit that detects a deviation of an air/fuel ratio from a predetermined range under a situation where purge gas is supplied to the intake passage;

a fuel injection amount calculating unit that calculates a fuel injection amount according to an expression including a correction factor for canceling an influence of the purge gas;

a correction factor updating unit that updates the correction factor so as to reduce the deviation of the air/fuel ratio; and an initial value setting unit that assigns an initial value to the correction factor when the canister check valve is placed in the closed state upon detection of the opening failure of the purge control valve, wherein a difference between a reference value of the correction factor and the initial value is larger than an update amount of the correction factor by which the correction factor is updated at a time by the correction factor updating unit.

29. The evaporative emission control system according to claim 28, further comprising:

a correction factor calculating unit that calculates the correction factor based on a fuel concentration of the purge gas;

a purge gas flow detecting unit that detects an amount of flow of the purge gas;

a gas flow determining unit that determines whether the amount of flow of the purge gas is smaller than an amount of tank vapor generated in the fuel tank when the opening failure is detected;

a first concentration setting unit that sets a fuel concentration equivalent to that of the tank vapor to the fuel concentration of the purge gas when the gas flow determining unit determines that the amount of flow of the purge gas is smaller than the amount of the tank vapor under a condition where the opening failure is detected; and a second concentration setting unit that calculates a reduced fuel concentration based on the fuel concentration equivalent to that of the tank vapor, the amount of the tank vapor and the amount of flow of the purge gas, and sets the reduced fuel concentration to the fuel concentration of the purge gas, when the gas flow determining unit determines that the amount of flow of the purge gas is equal to or larger than the amount of the tank vapor under the condition where the opening failure is detected.

30. The evaporative emission control system according to claim 28, wherein the opening failure detecting unit detects the opening failure of the purge control valve immediately after the engine is started.

* * * * *